US011317722B2

(12) United States Patent
Grace et al.

(10) Patent No.: US 11,317,722 B2
(45) Date of Patent: May 3, 2022

(54) COLLAPSIBLE AND PORTABLE CHAIR WITH INDEPENDENTLY MOVABLE LEG REST

(71) Applicant: GCI Outdoor, Inc., Higganum, CT (US)

(72) Inventors: Daniel R. Grace, Old Saybrook, CT (US); Bruce Agli, East Hampton, CT (US); Paul Titus Crotty, Waterford, CT (US)

(73) Assignee: GCI OUTDOOR LLC, Higganum, CT (US)

( * ) Notice: Subject to any disclaimer, the term of this patent is extended or adjusted under 35 U.S.C. 154(b) by 0 days.

(21) Appl. No.: 16/834,875

(22) Filed: Mar. 30, 2020

(65) Prior Publication Data

US 2020/0305608 A1 Oct. 1, 2020

Related U.S. Application Data

(60) Provisional application No. 62/826,013, filed on Mar. 29, 2019.

(51) Int. Cl.
*A47C 1/034* (2006.01)
*A47C 1/14* (2006.01)
(Continued)

(52) U.S. Cl.
CPC ..... *A47C 7/5068* (2018.08); *A47C 1/0265* (2013.01); *A47C 1/0342* (2013.01); *A47C 1/143* (2013.01); *A47C 4/34* (2013.01)

(58) Field of Classification Search
CPC ..... A47C 7/282; A47C 7/5066; A47C 7/5068; A47C 1/34; A47C 1/0342; A47C 1/0355;
(Continued)

(56) References Cited

U.S. PATENT DOCUMENTS 129,423 A * 7/1872 Perry ..... A47C 7/5066 297/423.31
715,388 A 12/1902 Kenny
(Continued)

FOREIGN PATENT DOCUMENTS

CA 3020908 A1 * 10/2017 ..... A47C 7/5068
CN 210672704 U * 6/2020
(Continued)

OTHER PUBLICATIONS

International Search Report and Written Opinion for PCT International Patent Application No. PCT/US2020/025793, dated Jun. 29, 2020.

*Primary Examiner* — Robert Canfield
(74) *Attorney, Agent, or Firm* — Lathrop GPM LLP; Wm. Tucker Griffith

(57) ABSTRACT

A collapsible and portable reclining chair includes a leg assembly, a seat assembly defining a seat support and a back support, and an independently movable leg rest support. Such a chair can be folded and unfolded between a set-up condition of the chair for use, and a collapsed and folded condition of the chair for transport and/or storage. In use, the seat assembly can be shifted between an upright position and a reclined position where the back support angularly pivots backwards. In use, the leg rest support can be pivotally shifted from a lowered position to an upright position relative to the seating assembly—operating similar to a conventional LA-Z-BOY recliner using a handle disposed on a side of the chair frame that is moved by the user to effectuate movement of the leg rest support independent of any reclining adjustment of the seat assembly.

21 Claims, 19 Drawing Sheets

(51) Int. Cl.
*A47C 7/50* (2006.01)
*A47C 1/026* (2006.01)
*A47C 4/34* (2006.01)

(58) Field of Classification Search
CPC ..... A47C 1/14; A47C 1/143; A47C 4/283; A47C 7/506; A47C 1/307
USPC ..... 297/69, 423.26, 423.32, 452.56
See application file for complete search history.

(56) References Cited

U.S. PATENT DOCUMENTS 1,214,701 A 2/1917 Meranyk
2,020,207 A * 11/1935 Platter ..... A47C 7/66 297/29
2,132,525 A 10/1938 Burchall
2,560,985 A * 7/1951 Rideout ..... A47C 1/0325 297/82
2,571,463 A * 10/1951 Lorenz ..... A47C 1/035 297/29
2,638,970 A 5/1953 Harber
3,596,983 A * 8/1971 Ramillon ..... A47C 4/22 297/78
4,076,303 A * 2/1978 Korenblit ..... A47C 7/5066 297/30
4,715,650 A 12/1987 Berman et al.
4,792,181 A * 12/1988 Guichon ..... A47C 4/26 297/28
4,898,421 A 2/1990 Brunn
4,938,603 A * 7/1990 Turner ..... A47D 1/023 297/16.1
5,039,167 A * 8/1991 Sweet ..... A47C 1/04 297/423.37
5,855,409 A 1/1999 Tseng
5,931,526 A 8/1999 Tseng
6,302,479 B1 10/2001 Zheng
6,382,727 B1 * 5/2002 Pickard ..... A47C 7/506 297/30
6,402,232 B1 * 6/2002 Tsai ..... A47C 1/0342 297/68
6,692,068 B1 * 2/2004 Tang ..... A47C 1/035 297/16.2
6,817,671 B1 11/2004 Zheng
6,840,574 B1 1/2005 Wu
7,017,984 B2 3/2006 Chen
7,950,734 B2 5/2011 Zheng
8,251,442 B2 8/2012 Grace
8,636,317 B2 * 1/2014 Wu ..... A61G 5/0875 297/19
8,746,802 B1 * 6/2014 Delmestri ..... A47C 7/506 297/423.19
8,864,222 B2 10/2014 Grace
9,113,713 B2 * 8/2015 Lin ..... A47C 1/03294
2002/0125745 A1 * 9/2002 Lee ..... A47C 1/027 297/30
2003/0011219 A1 * 1/2003 Chun-Yueh ..... A47C 17/70 297/51
2003/0034675 A1 4/2003 Marx
2005/0264049 A1 * 12/2005 Fleites ..... A47C 1/143 297/188.04
2011/0227374 A1 * 9/2011 Zhu ..... A47C 7/624 297/46
2013/0328360 A1 12/2013 Kim
2014/0159437 A1 * 6/2014 Humphreys ..... A47C 7/62 297/90
2019/0110599 A1 4/2019 Grace

FOREIGN PATENT DOCUMENTS

CN 113317647 A * 8/2021
DE 212014000058 U1 * 11/2015 ..... A47C 7/506
DE 202016104646 U1 * 10/2016 ..... A47C 4/18
FR 797067 A * 4/1936 ..... A47C 1/143
FR 1187221 A * 9/1959 ..... A47C 20/043
FR 3058303 A1 * 5/2018 ..... A47C 4/04
JP 2000184932 A * 7/2000 ..... A47C 1/143

* cited by examiner

COLLAPSIBLE AND PORTABLE CHAIR WITH INDEPENDENTLY MOVABLE LEG REST

CROSS-REFERENCE TO RELATED APPLICATION

This application claims the benefit of U.S. Provisional Application Ser. No. 62/826,013, filed Mar. 29, 2019, which is incorporated herein by reference in its entirety.

FIELD OF THE INVENTION

The present invention generally relates to folding chairs, and more particularly relates to improvements in reclining chairs that are foldable and unfoldable between a set-up condition for use and a substantially collapsed condition for transportation and/or storage, and even more particularly, relates to an independently movable leg rest for use on such reclining chairs.

BACKGROUND OF THE INVENTION

Popularity of the mini van, the sport utility vehicle and the recreational vehicle has resulted in increased demand for improved collapsible furniture and particularly collapsible portable furniture of the outdoor type which may be readily stowed in a vehicle and conveniently manually transported to a picnic area or the site of a spectator event, such as, for example, an outdoor concert, a sporting event, a golf tournament, or an air show, where the general rule is to bring your own seating accommodations.

Considerable attention has been directed to the provision of improved lightweight, portable and collapsible furniture for the picnicker, spectator, sportsman, hunter, fisherman, hiker, biker and the like. However, the resulting furniture designs and particularly the designs for chairs and seats have usually incorporated some reduction in size, as compared to the full-sized article, with a corresponding reduction in the level of seating comfort. The wooden beach chairs and lawn furniture of an earlier era have generally been replaced by light-weight tubular metal furniture of a more modern design. However, little has been done to optimize the collapsibility and portability of the full-sized article without compromising comfort, which is a general goal of the present invention.

Beach and lawn chairs adapted to be folded for transportation and/or storage typically have a frame fabricated from elongated structural members, preferably metal. The frames of such chairs generally have transversely spaced-apart left-hand and right-hand frame side assemblies that are substantially parallel to each other. In a set-up condition, each frame side assembly has a front leg member and a rear leg member connected directly or indirectly to an upper end of the front leg member. For example, in some designs, the front and rear leg members extend in an angled direction—the front towards the back of the chair and the rear towards the front of the chair—to meet at a pivotal connection point. In other designs, the front leg member and the rear leg member crisscross and are pivotally connected to one another at a respective intermediate location of each leg member. Such frame side assemblies also often include an upwardly extending chair back support member and a horizontally extending seat support member (when the chair is in its set-up condition), which are pivotally connected with the leg assemblies to facilitate folding of the chair frame to a collapsed condition. Such frames often also include armrests extending forward from the back support members and connected by some means to at least the front leg members.

Conventional beach and lawn chairs of the prior art having the left-hand and right-hand frame side assemblies such as hereinbefore generally described also commonly have transversely extending rigid connecting members providing fixed connection between the front leg members, the rear leg members, and often the back and seat support members as well. These rigid or non-collapsible transversely extending connecting members are either generally horizontally disposed or transversely diagonally extending when such a conventional prior art chair is in its set-up condition.

Conventional beach and lawn chairs of the prior art also have fabric or flexible panels stretched between the frame members for receiving a seated user in the set-up condition of the chair. Such panels general define a seat and back support capable of supporting the seated user's weight.

Such prior art chairs provide the convenience of easy fold-up, and are lightweight so as to permit easy transportability. Common uses for such chairs are at the beach or at a picnic where easy set-up and break-down, as well as the ability to carry the chair along with other things, is desirable. Due to the intricate interconnection of all the frame members, both front-to-back and side-to-side, such chairs often require all the legs to remain in contact with the ground to ensure safety and structural integrity of the chair during use. However, there is a desire for a reclining chair that is likewise foldable and portable, so that a user at a picnic or an outdoor event can relax in their chair or recline as desired. Conventional beach and lawn chairs have heretofore been constructed as described herein, and further provided the capability of a reclining back support. In such prior art chairs, the angular position of the back support is often adjusted by moving the armrests back and forth.

Similar prior art foldable chairs, generally known in the art as "zero-gravity chairs," also provide a chair frame that allows the user to recline while seated. Such prior art zero-gravity chairs generally comprise a leg assembly, where the front leg members and the rear leg members are pivotally connected, and a seat assembly where the back support member and the seat support member are connected and collectively movable relative to the leg assembly to reclined the back support of the chair. Such prior art designs often also include a leg rest or footrest extension projecting off the forward end of the seat support. However, the leg rest/footrest extension is only usable when the seat assembly is reclined. That is, the back support and the leg rest/footrest work in tandem. As a result, the user cannot use the leg rest/footrest extension when seated in an upright position, so if the user wishes to have her feet raised, she must lounge far backwards. Similarly, the user cannot be in a reclined position of the chair without the leg rest/footrest extension being extended. In general, the leg rest/footrest extension is fixed to the seat assembly, and cannot be independently moved by the user as desired.

In accordance with known zero-gravity reclining chair designs of the prior art, the seat assembly is moved to recline the back support of the chair by shifting of the user's weight in coordination with rearward movement of the armrests, which are slidingly mounted on top of the leg assembly. In the reclining movement of the seat assembly, the back support pivots backward, the armrests slid backward with movement of the back support, and the leg rest extension pivots upward, as the top end of the leg rest extension is pivotally connected to the front end of the armrests. In such a prior art design, the back support can be reclined whenever a sufficient force is applied—e.g., the user leaning back on the back support. Accordingly, in the upright position of the set-up chair, the position of the armrests must be manually locked, and then manually unlocked to recline the back support. As so designed, if the user forgets to lock the armrests, there is a safety issue as nothing prevents recline of the back support and an unaware user can be startled and hurt.

Similarly, in conventional designs of reclining chairs, the armrests must be unlocked before the chair can be collapsed and folded—front-to-back like a conventional lawn chair. If the armrests are locked, then the chair will not fold. However, that also means that in the folded condition of the chair, the armrests are unlocked, so that upon set-up of the chair, the armrests will remain unlocked until manually locked. This again presents a safety concern to the unaware user who may sit on a set-up chair and not realize that any backward weight shift will cause the back support to recline unless and until the armrests are manually locked in place. Still further, in conventional reclining chair designs with a leg rest, given that movement of the leg rest is generally interlinked with movement of the back support, in such unsafe situations, any backward weight shift will also cause the leg rest to move upwards, which could pose further safety risks to an unaware user.

In view of the foregoing, there is a need for a chair that can be reclined by a seated user when in a set-up condition that can also be collapsed in order to reduce the space occupied by the chair in a folded condition. Further, there is a need for such a chair with an independently movable leg rest or footrest extension, so that the chair can be enjoyed in a variety of set-up conditions, such as upright, upright with leg rest/footrest, reclined with leg rest/footrest. Further, there is a need for such a chair that can be folded with minimal effort, without limiting or compromising the structural features permitting reclining of the chair for independent use of the leg rest/footrest. Further, there is a need for a chair that can be reclined by a seated user, as desired, without compromising the folding and transport of the chair, and without affecting the safety and structural integrity of the chair, especially on all types of surfaces, including soft ground and sand.

Accordingly, it is a general object of the present invention to provide a foldable and portable chair design with an independently movable leg rest or footrest extension that overcomes the problems and drawbacks associated with folding chairs and reclining chairs, and therefore significantly improves the utility of such a reclining chair in the set-up condition while permitting easy transportation and/or storage in a collapsed condition.

The present invention addresses these issues, and provides a means to circumvent the associated drawbacks of such prior art foldable reclining chair designs.

SUMMARY OF THE INVENTION

The present invention is directed to a collapsible and portable reclining chair design especially suitable for use as a beach chair, a lawn chair, and the like, where the chair, in a set-up condition, can be reclined by a seated user, and where the chair can be folded from the set-up condition to a collapsed condition for transportation and/or storage. Additionally, the chair design in accordance with the present invention includes an independently movable leg rest or footrest extension where a seated user can use the chair in a variety of set-up conditions.

In accordance with a first embodiment of the present invention, a collapsible and portable reclining chair includes a leg assembly, a seat assembly and an independent leg rest. Such a chair can be folded and unfolded between a set-up condition of the chair for use, and a collapsed and folded condition of the chair for transport and/or storage. In preferred embodiments, the chair is folded in a front-to-back manner, as conventionally used for traditional lawn and beach chair designs.

The seat assembly of the chair in accordance with a first aspect of the present invention is pivotally mounted on and relative to the leg assembly. The seat assembly receives a seated user in accordance with intended use of the chair, and generally comprises a back support, a seat support, and a forward frame portion projecting from the forward end of the seat support. The seat assembly further includes left and right armrests pivotally connected at a rear end to the back support and at the forward end to the forward frame portion. In use, the seat assembly can be shifted between an upright position (e.g., a normal seated position of use) and a reclined position where the back support pivots backwards and the forward frame portion pivots upward, as in accordance with known zero-gravity lounger designs. Further, the seat assembly can be folded and unfolded between the set-up condition and the collapsed condition of the chair in coordination with the leg assembly.

In an embodiment of the seat assembly, the seat assembly is pivotally connected to the leg assembly such that the seat assembly can be reclined as desired. As noted, the left and right sides of the chair in accordance with preferred embodiments of the present invention include left and right armrests, respectively. More particularly, a seated user uses the armrests to adjust the angular position of the back support relative to the horizontal when the chair is in its set-up condition.

In accordance with preferred embodiments of the present invention, the reclining chair includes an independently movable leg rest or footrest extension attached to the seat assembly. More particularly, the leg rest is pivotally attached to a forward end of the seat support. In alternate designs, the leg rest can be attached to the front legs of the leg assembly. In use, the leg rest extension can be pivotally shifted from a lowered position to an upright position—operating similar to a conventional LA-Z-BOY recliner using a handle disposed on a side of the chair frame that is moved by the user to effectuate movement of the leg rest independent of any reclining adjustment of the seat assembly.

In accordance with preferred embodiments of the present invention, the handle is connected to the leg rest via a cam/linkage actuating mechanism that coordinates movement of the handle with a responsive pivoting action of the leg rest. In use, pushing down on the handle causes the linkage mechanism to pivot, in turn lifting the leg rest extension. When the handle is pulled up, a reverse action occurs so that the leg rest can be pivoted or lowered downward. When the leg rest is down, it is generally disposed within the frame of the forward frame portion of the seat assembly. In this regard, when the seat assembly is reclined (such that the forward frame portion pivots upward), there is no interference between the leg rest and the forward frame portion.

The leg rest is independently movable relative to the seat assembly. Thus, the leg rest can be raised without the seat assembly needing to be reclined. Accordingly, pushing down on the handle will cause the leg rest to pivot up regardless of the position of the seat assembly. Thus, the leg rest can be raised even when the chair is in its upright set-up condition. The leg rest can likewise be raised in coordination with reclining the chair. Alternatively, the leg rest can be lowered/ down in the upright condition of the chair. These options differ from the prior art designs, which keep any leg rest or footrest rigidly connected to the seat assembly and only allow the leg rest/footrest to go up if and when the chair is reclined.

In accordance with a second embodiment of the present invention, a collapsible and portable reclining chair includes a back support, a seat support, and a leg rest support, wherein said leg rest support is independently movable relative to the seat support and the back support. The chair further includes an actuating mechanism for moving the leg rest support between a raised position and a lowered position, said actuating mechanism preferably comprising a handle pivotably linked to the leg rest portion to actuate movement thereof. Still further, the back support is adjustable to various angular or reclined positions relative to the seat support, wherein the adjustment of the back support is independent of the position of the leg rest support. Such a chair can further be folded and unfolded between a set-up condition of the chair for use, and a collapsed and folded condition of the chair for transport and/or storage. In preferred embodiments, the chair is folded in a front-to-back manner, as conventionally used for traditional lawn and beach chair designs.

In use, the leg rest support can be pivotally shifted from a lowered position to an upright position, preferably using the handle disposed on a side of the chair frame that is moved by the user to effectuate movement of the leg rest support independent of any reclining adjustment of the back support. As a result, the leg rest support is independently movable relative to the back support. Thus, the leg rest support can be raised without the back support needing to be reclined. Accordingly, pushing down on the handle will cause the leg rest support to pivot up regardless of the position of the back support. Thus, the leg rest support can be raised even when the chair is in its upright set-up condition. The leg rest support can likewise be raised in coordination with reclining the back support. Alternatively, the leg rest can be kept down in the upright condition of the chair, whether the back support is reclined or not.

In accordance with another aspect of the present invention, each armrest also includes an adjustment mechanism for unlocking, moving, and then locking the position of the armrest. In an embodiment of the present invention, the underside of each armrest includes a slide mechanism that interacts with the leg assembly to lock the position of the back support during use of the chair.

These and other features of the present invention are described with reference to the drawings of preferred embodiments of a collapsible and portable rocking chair. The illustrated embodiments of features of the present invention are intended to illustrate, but not limit the invention.

DETAILED DESCRIPTION OF EMBODIMENTS OF THE INVENTION

Figure 1:
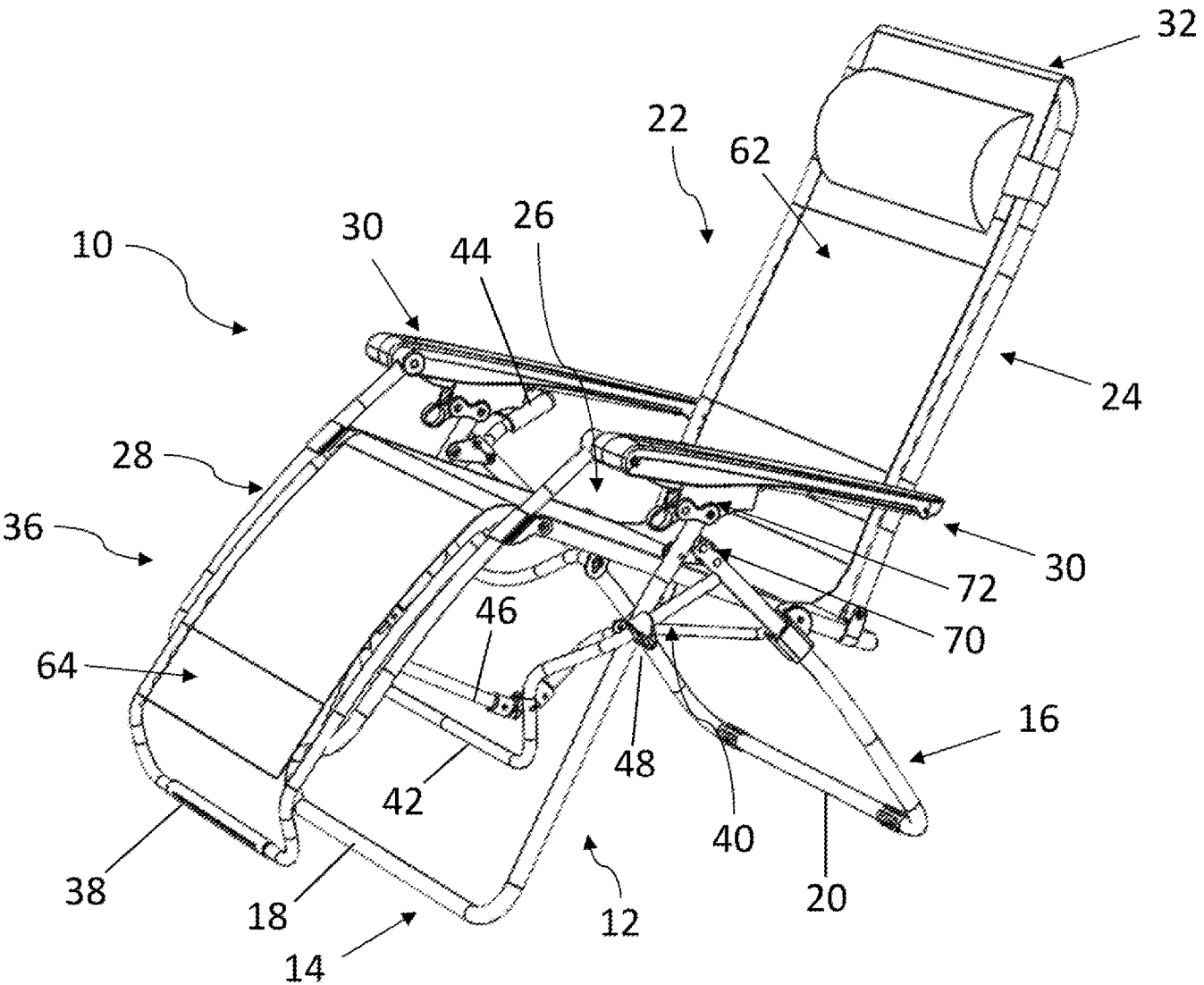
FIG. 1 is a perspective view of a collapsible and portable chair in accordance with a first embodiment of the present invention with the chair in a set-up condition and upright, and with an independently movable leg rest support in a lowered position.

In the drawings and in the description that follows, the present invention is illustrated and described with reference to collapsible and portable reclining chair designs embodying the present invention.

Figure 2:
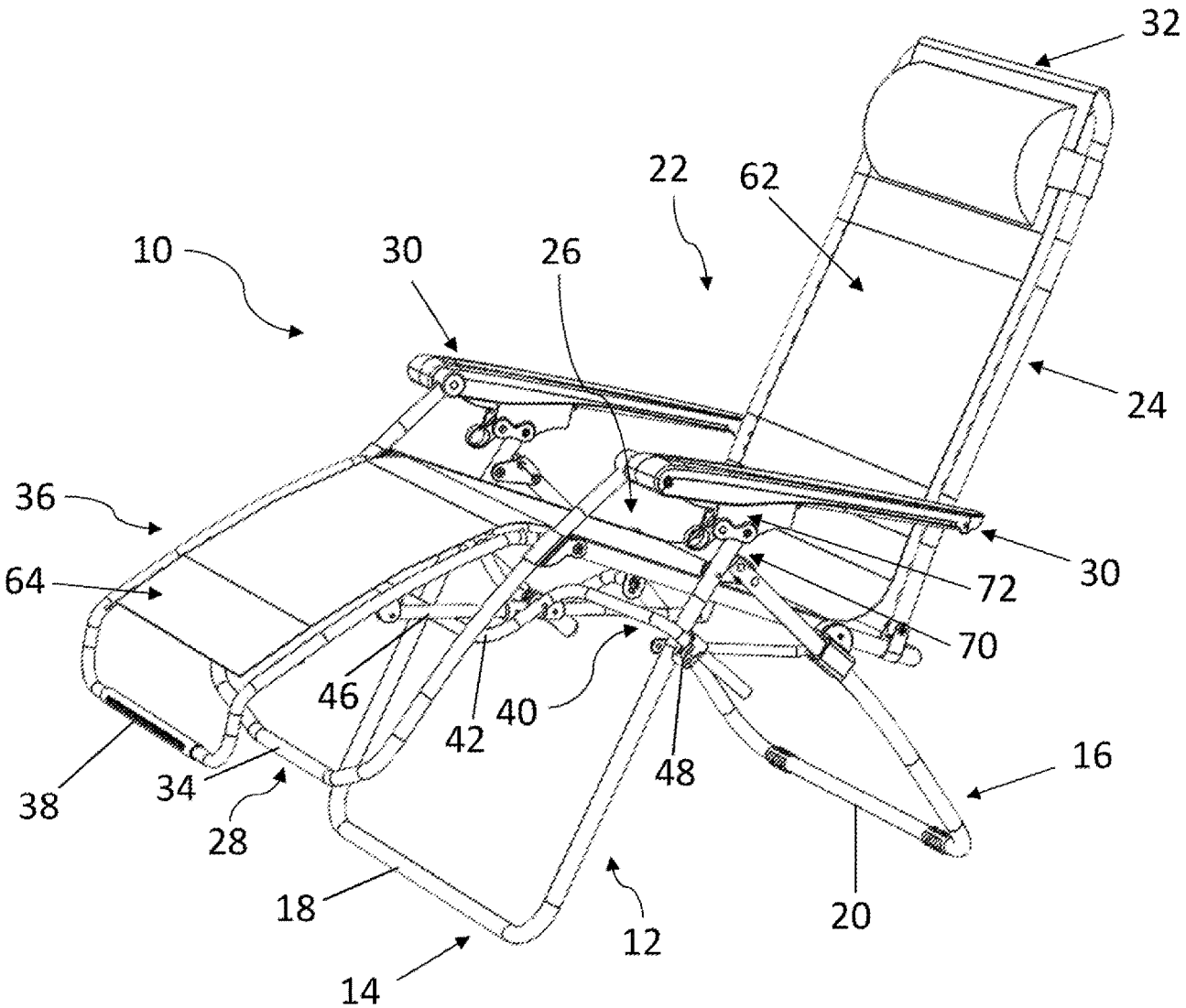
FIG. 2 is a perspective view of the collapsible and portable chair of FIG. 1 with the chair in a set-up condition and upright, and with the independently movable leg rest support in a raised position.
Figure 3:
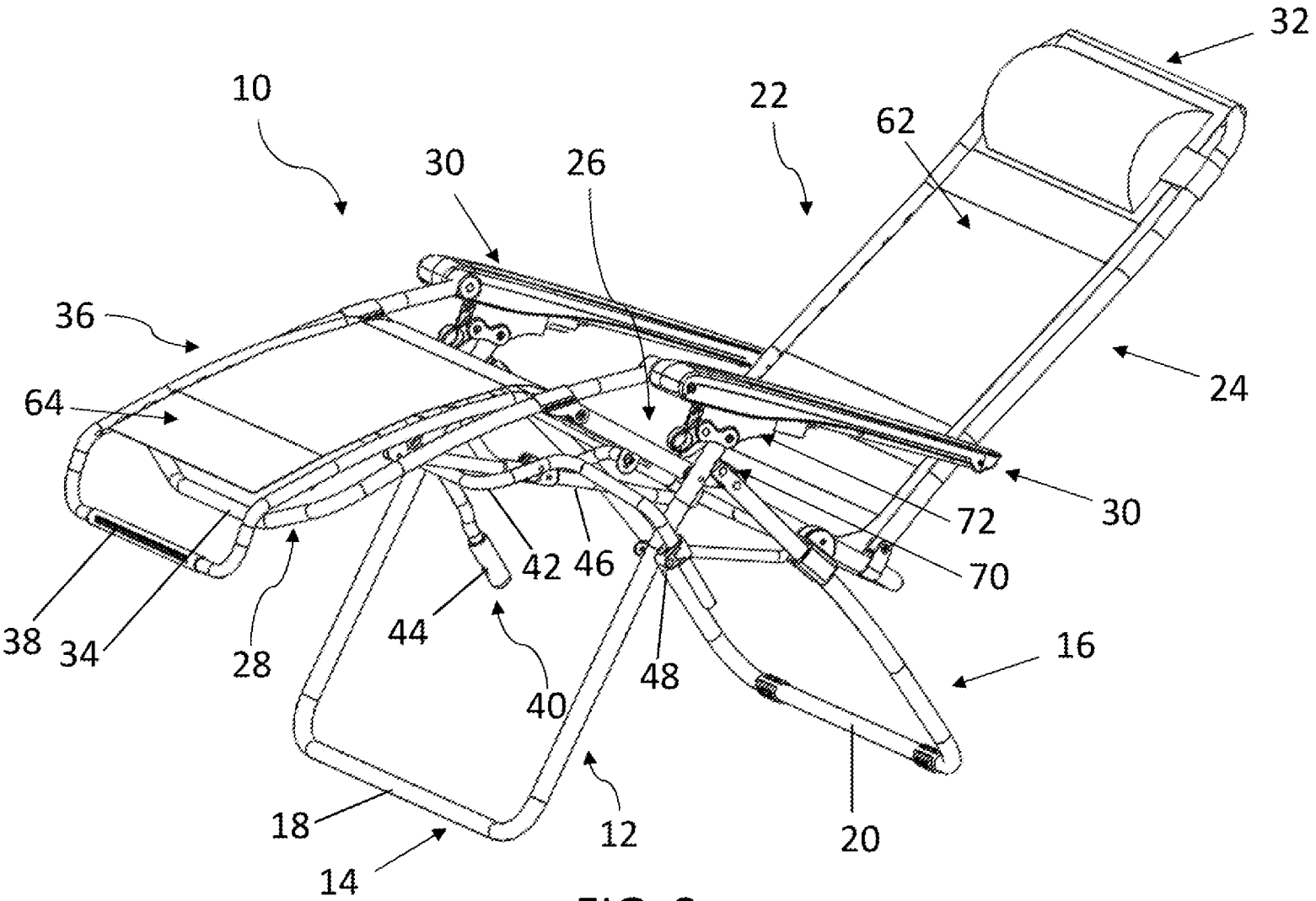
FIG. 3 is a perspective view of the collapsible and portable chair of FIG. 1 with the chair in a set-up condition and reclined, and with the independently movable leg rest support in a raised position.

A first embodiment of a collapsible and portable reclining chair in accordance with the present invention is shown, for example, in FIGS. 1-3 in a set-up condition ready for use and generally designated by reference numeral 10. As illustrated, the chair 10 is a zero-gravity-style folding and reclining chair. In accordance with an aspect of the present invention, an independently movable leg rest extension is provided on the chair, as described in more detail below. As a result, FIG.

1 illustrates the chair 10 in a set-up and upright condition, with the independently movable leg rest in a lowered position. By comparison, FIG. 2 illustrates the chair 10 in a set-up and upright condition, with the independently movable leg rest in a raised position. Still further, FIG. 3 illustrates the chair 10 in a set-up and reclined condition. Lastly, FIG. 4 illustrates the chair 10 in its collapsed condition for transport and/or storage.

Referring to FIGS. 1-9, the chair 10 includes a chair frame comprising a leg assembly 12, a seat assembly 22 and an independent leg rest 36, as illustrated. Such a chair 10 can be folded and unfolded between a set-up condition of the chair 10 for use, and a collapsed and folded condition of the chair 10 for transport and/or storage. In preferred embodiments, the chair 10 is folded in a front-to-back manner, as conventionally used for traditional lawn and beach chair designs, though the present invention can also be used on chair designs adapted for folding in different manners, such as X-Y folding chairs and bi-fold chairs, without departing from the principles and spirit of the present invention.

Figure 5:
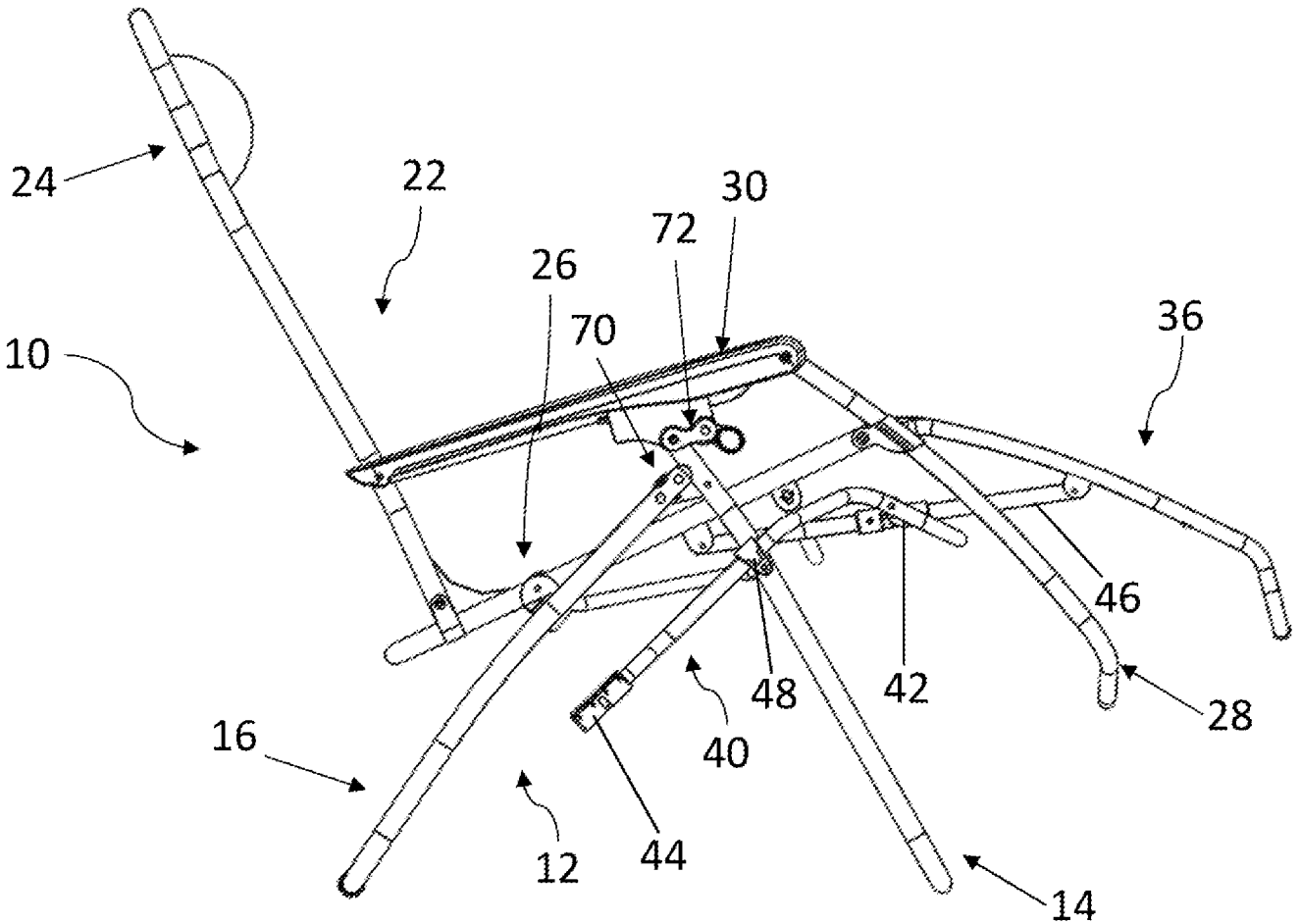
FIG. 5 is a planar right-side view of the collapsible and portable chair of FIG. 1 in a set-up and upright condition, and with the leg rest support in an elevated position.
Figure 6:
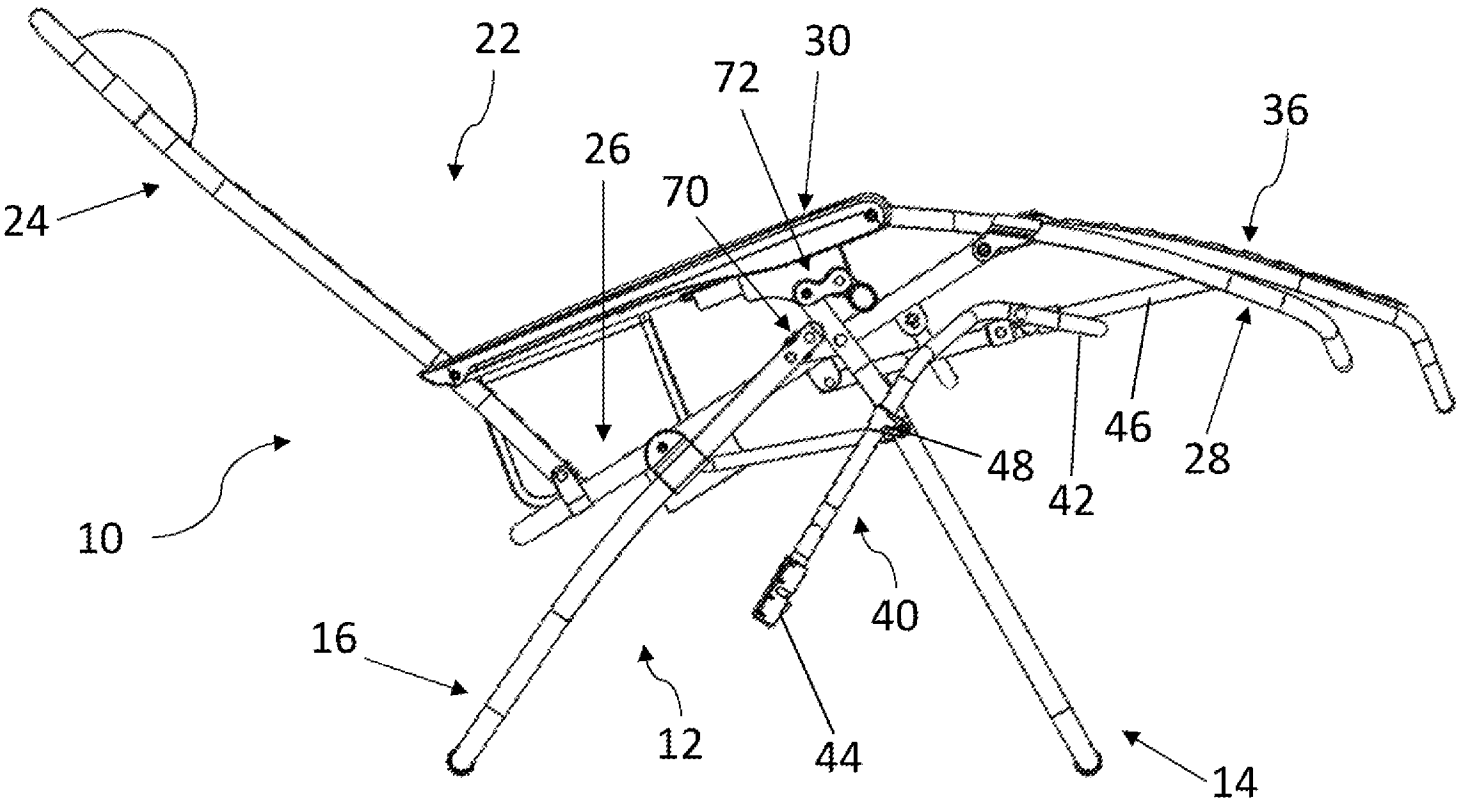
FIG. 6 is a planar right-side view of the collapsible and portable chair of FIG. 1, in a set-up and reclined condition, and with the leg rest support in an elevated position.

Referring to FIGS. 5-6, the leg assembly 12 generally comprises front and rear legs 14 and 16 pivotally connected to each other. More particularly, the chair frame includes left and right mirrored frame members to effectively define left and right front and rear legs 14 and 16, as illustrated more clearly in FIGS. 1-3. More preferably, the chair 10 also includes transverse connectors 18 and 20 connecting the left and right leg members 14 and 16 that transversely support the chair frame in the set-up condition of the chair 10. Essentially, each of the front leg and rear leg 14 and 16 of the chair 10 resembles a U-shaped leg member having two parallel members interconnected by a transversely extending central portion, though alternate leg designs can be used without departing from the principles and spirit of the present invention.

Figure 4:
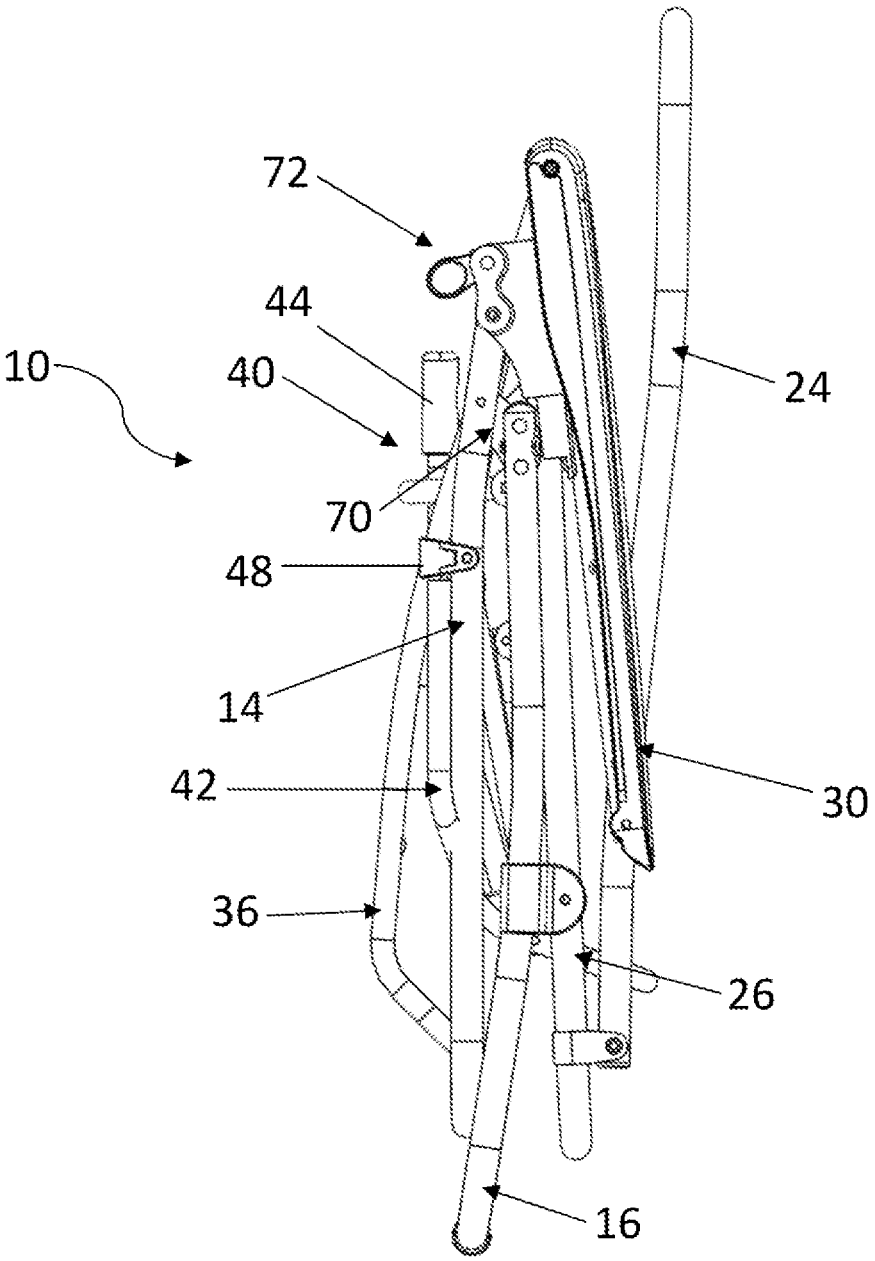
FIG. 4 is a planar side view of the collapsible and portable chair of FIG. 1 is a collapsed condition.

The upper portions of the front and rear legs 14 and 16 are pivotally connected to each other so that the leg assembly 12 can be pivoted between a set-up condition—where the front and rear legs 14 and 16 are splayed apart to support the chair frame, as illustrated in FIGS. 5-6—and a collapsed condition—where the front and rear legs 14 and 16 are adjacent and generally parallel to one another relative to their set-up positions, as illustrated in FIG. 4.

The seat assembly 22 of the chair 10 is pivotally mounted on and relative to the leg assembly 12. The seat assembly 22 receives a seated user in accordance with intended use of the chair 10, and generally comprises a back support 24, a seat support 26, and a forward frame portion 28 projecting from the forward end of the seat support 26. The seat assembly 22 further includes left and right armrests 30 pivotally connected at a rear end to the back support 24 and at the forward end to the forward frame portion 28. In use, the seat assembly 22 can be shifted between an upright position (e.g., a normal seated position of use), as illustrated in FIGS. 1-2 and 5, and a reclined position, as illustrated in FIGS. 3 and 6, where the back support 24 pivots backwards and the forward frame portion 28 pivots upward, as in accordance with known zero-gravity lounger designs. Further, the seat assembly 22 can be folded and unfolded between the set-up condition (FIGS. 1-3) and the collapsed condition (FIG. 4) of the chair 10 in coordination with the leg assembly 12.

As with a preferred design of the leg assembly 12, the seat assembly 22 of the chair frame includes left and right mirrored frame members to effectively define left and right back support members 24, seat support members 26 and forward frame members 28. Additionally, in the illustrated embodiments, the chair 10 also includes transversely extending connectors 32 and 34 connecting the left and right back support members 24 and the left and right forward frame members 28, respectively, that transversely support the weight of a seated user in the set-up condition of the chair 10. Essentially, each of the back support 24 and forward frame portion 28 of the chair 10 resembles a U-shaped frame member having two parallel members interconnected by a transverse central portion, though alternative frame designs can be used without departing from the principles and spirit of the present invention. The seat support 26 is pivotally positioned between the back support 24 and the forward frame portion 28.

In a preferred embodiment of the leg assembly 12, one of the front or rear legs 14 or 16 extends upward from a collective pivot point to define a connection point 70 for the armrests 30 of the chair 10. More particularly, a slide housing 72 is provided at top of the leg assembly 12 for receiving, supporting and engaging with the armrests 30 for sliding movement in use of the chair 10 to effectuate reclining movement of the back support 24. Indeed, backwards and forward movement of the armrests 30 permits selective adjustment of the angular position of the back support 24 relative to the horizontal so that the user can position the back support 24 at a desired reclined position.

More particularly, a seated user uses the armrests 30 to adjust the angular position of the back support 24 relative to the horizontal when the chair 10 is in its set-up condition and the user is seated in the chair 10. As noted and shown, the armrests 30 are pivotally attached at their back end to the back support members 24 and adapted for adjustment, in connection with said back support members 24, to recline the back support 24 of the chair 10. In this regard, the forward end of each armrest 30 is pivotally attached to an upper portion of the forward frame members 28. As the armrests 30 are moved rearward, preferably in coordination with a shifting of the seated user's weight, the armrests 30 push the back support 24 backwards in a downward pivoting manner relative to the seat support 26. This movement shifts the seat support 24 while also pulling the forward frame portion 28—which is connected to the seat support 26—backwards, as well as in an upward pivoting manner relative to the seat support 26.

In accordance with preferred embodiments of the present invention, the reclining chair 10 includes an independently movable leg rest or footrest extension 36 attached to the seat assembly 22. More particularly, the leg rest 36 is pivotally attached to a forward end of the seat support 26, as illustrated in FIGS. 1-3 and 8. In alternate designs, the leg rest 36 can be pivotally attached to the front legs 14 of the leg assembly 12. The leg rest 36 comprises a generally U-shape frame portion having parallel spaced apart left- and right-side frame members 36 and a transversely extending central portion 38, though again alternate designs can be used without departing from the principles and spirit of the present invention. A fabric panel 64 extends between the leg rest frame to support a seated user's legs and feet. In use, the leg rest extension 36 can be pivotally shifted from a lowered position (as shown in FIGS. 1 and 5) to a raised position (as shown in FIGS. 2-3 and 6-8)—operating similar to a conventional LA-Z-BOY recliner using a handle 40 disposed on a side of the chair frame that is moved by the user to effectuate movement of the leg rest 36 independent of any reclining adjustment of the seat assembly 22.

Figure 9:
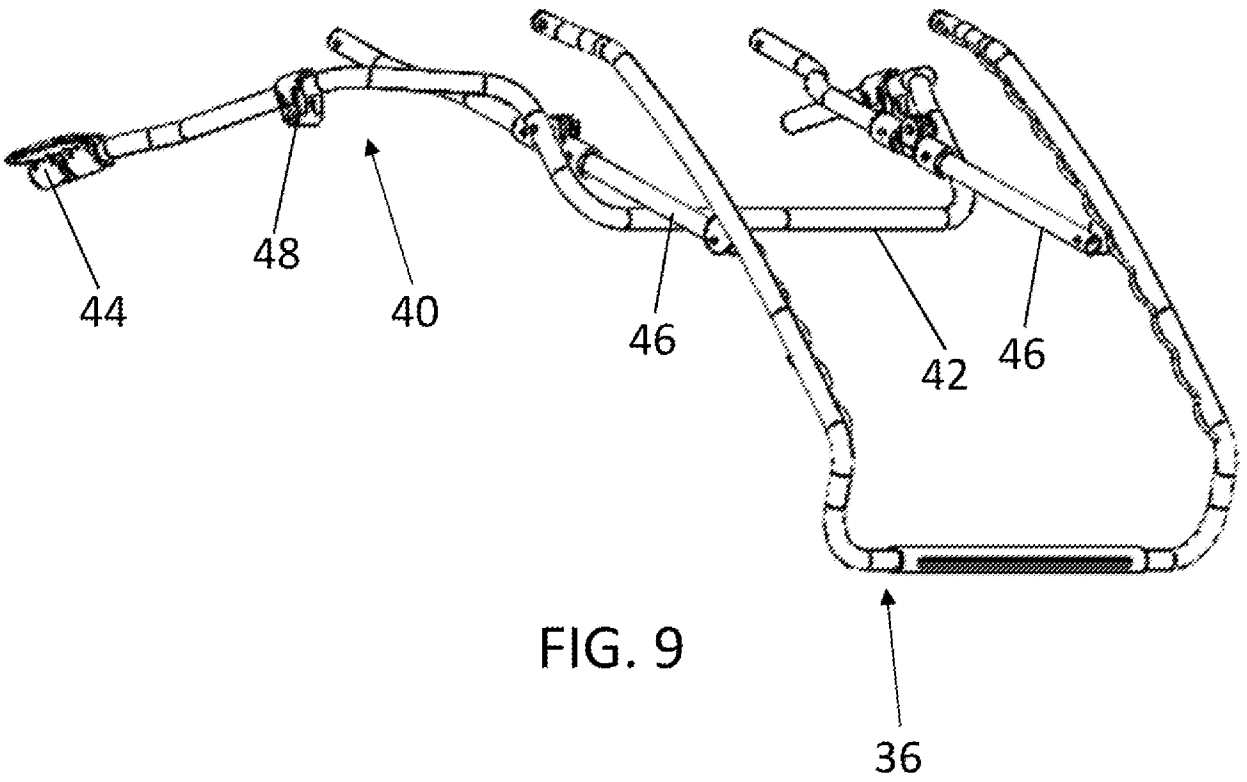
FIG. 9 is a perspective view of an isolated actuating mechanism in accordance with the present invention for use in effecting movement of the leg rest in the collapsible and portable chair of FIG. 1.

In accordance with preferred embodiments of the present invention and as generally illustrated in FIG. 9, the handle 40 is connected to the leg rest 36 via a cam/linkage mechanism that coordinates movement of the handle 40 with a responsive pivoting action of the leg rest 36. As illustrated in FIGS. 1-3, 7 and 9, the handle 40 generally comprises a U-shaped member 42 pivotally connected to and anchored by the front leg 14 of the leg assembly 12 and having a grip 44 on at least one side for the user to manipulate as desired. In alternate designs, a grip 44 can be provided on both sides of the chair 10. The U-shaped handle member 42 is pivotally connected to generally parallelly spaced apart support members 46 connected between said U-shaped handle member 42 and the leg rest 36. A rear portion of each support member 46 is pivotally attached to and anchored by the seat support 26 of the seat assembly 22 to provide a fulcrum. In use, pushing down on the handle 40 causes the support members 46 to pivot up, in turn lifting the leg rest extension 36. When the handle 40 is pulled up, a reverse action occurs so that the leg rest 36 can be pivoted or lowered downward. When the leg rest 36 is down, it is generally disposed within the frame of the forward frame portion 28 of the seat assembly 22, as illustrated in FIG. 1. In this regard, when the seat assembly 22 is reclined (such that the forward frame portion 28 pivots upward), there is no interference between the leg rest 36 and the forward frame portion 28.

Therefore, in accordance with the present invention, the leg rest 36 is independently movable relative to the seat assembly 22. Thus, the leg rest 36 can be raised without the seat assembly 22 needing to be reclined. Accordingly, pushing down on the handle 40 will cause the leg rest 36 to pivot up regardless of the position of the seat assembly 22. Thus, the leg rest 36 can be raised even when the chair 10 is in its upright set-up condition. The leg rest 36 can likewise be raised in coordination with reclining the chair 10. In this regard, the chair 10 can operate much like a conventional zero-gravity reclining chair. That is, when the leg rest 36 is lowered and disengaged, it rests on the forward frame portion 28 of the seat assembly 22. When the user shifts her weight rearward to recline the seat assembly 22, the forward frame portion 28 pivots upward and can move the leg rest 36 upwards as well, as shown in FIGS. 3 and 6. Alternatively, the leg rest 36 can be lowered/down in the upright condition of the chair 10. Still further, alternate designs can keep the leg rest 36 in a lowered position even when the seat assembly 22 is reclined (where there is no interference between the leg rest 36 and the forward frame portion 28). These options differ from the prior art designs, which keep any leg rest or footrest extension rigidly connected to the seat assembly and only allow the leg rest/footrest to go up if and when the chair is reclined.

Referring to FIGS. 1-3 and 5-7, the handle 40 is pivotally mounted on and anchored by the front leg 14 using a sleeve or brace 48 that provides a fulcrum for the handle 40 for effecting movement of the leg rest 36. The handle 40 also engages an over-center assembly (not shown) to lock the leg rest 36 when it is pivoted upwards so that it can only pivot back down when the user engages the handle 40 and pulls it up.

Figure 7:
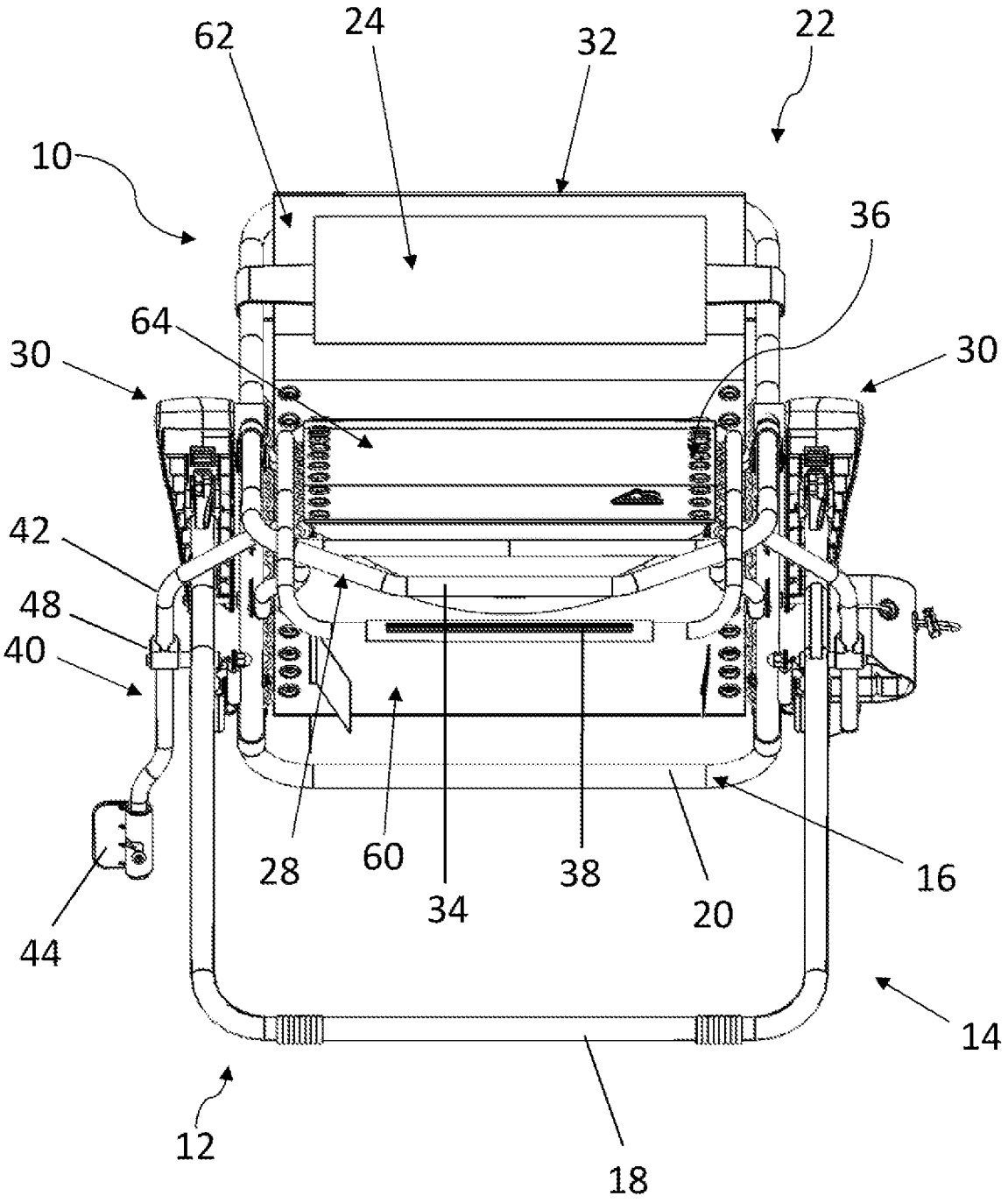
FIG. 7 is a planar front view of the collapsible and portable chair of FIG. 1 in the arrangement of FIG. 6.
Figure 8:
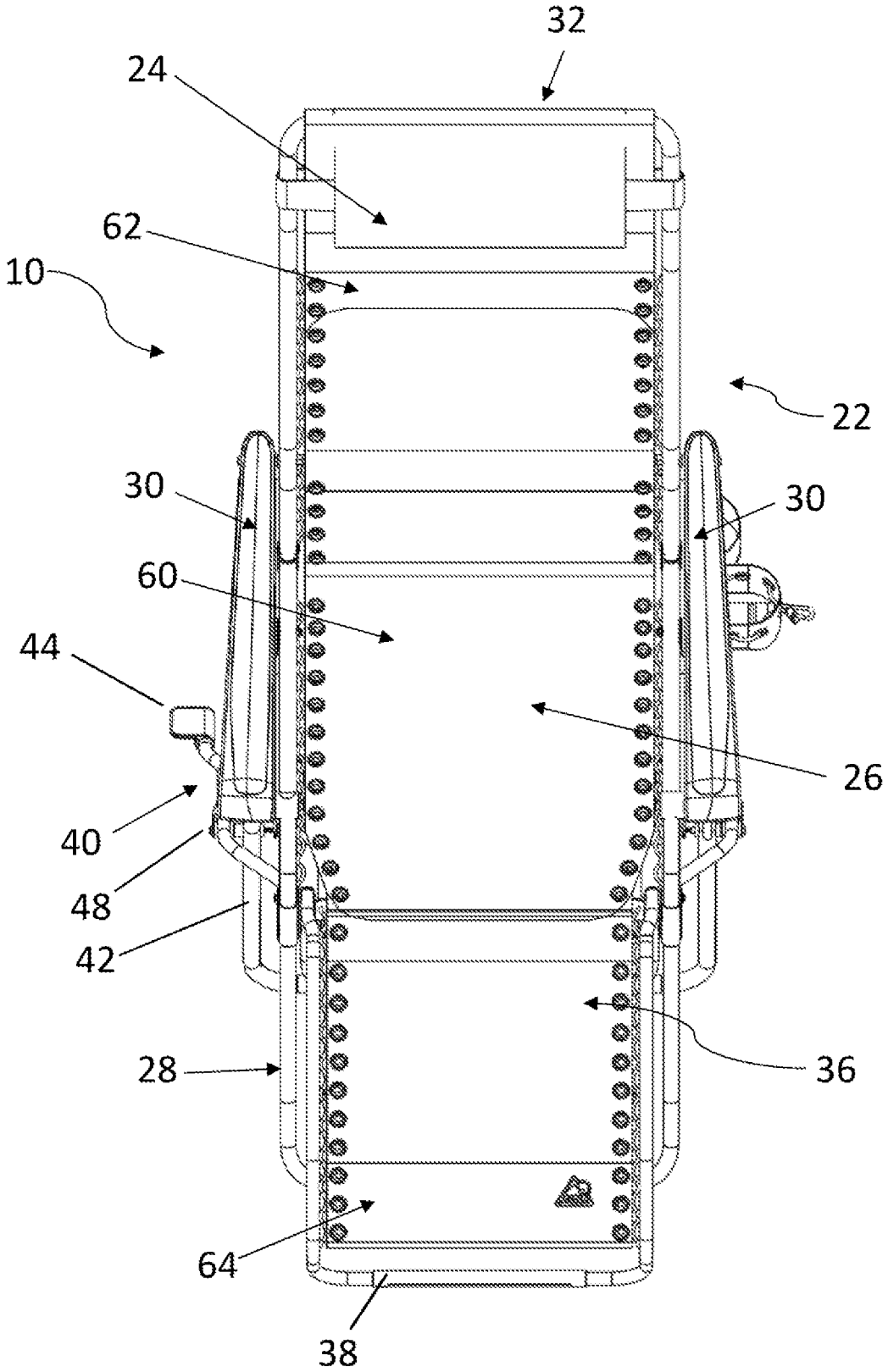
FIG. 8 is a planar top view of the collapsible and portable chair of FIG. 1 in the arrangement of FIG. 4.

Referring to FIGS. 7-8, the chair 10 further includes a seat panel 60 supported by the seat support 26 and a back support panel 62 supported by the back support 24 for collectively accommodating a user seated in the chair 10, though such panels 60 and 62, including the leg rest panel 64, need not be discrete and can be formed from a single or connected panel of fabric or flexible material.

Figure 11:
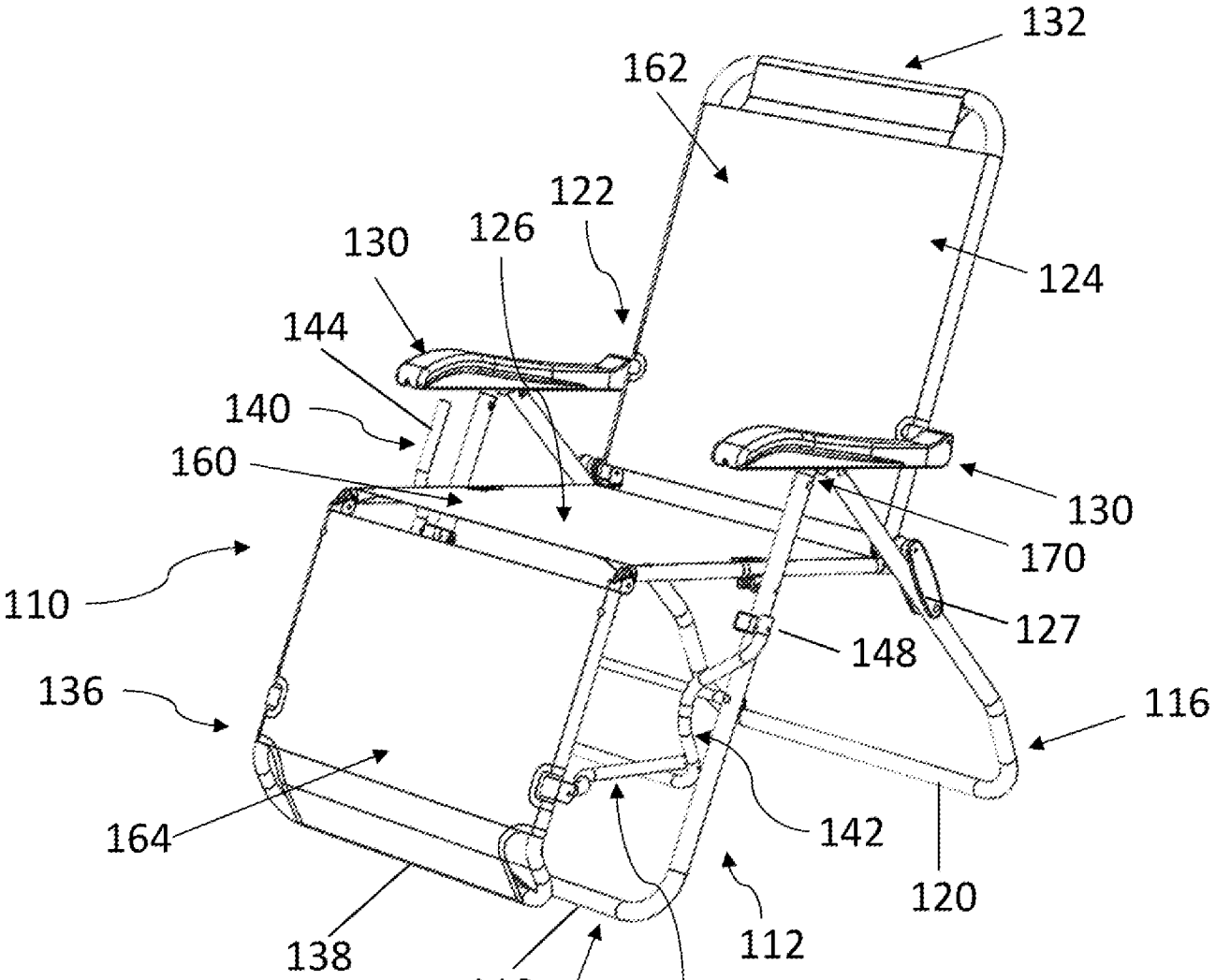
FIG. 11 is a perspective view of a collapsible and portable chair in accordance with a second embodiment of the present invention with the chair in a set-up condition and upright, and with an independently movable leg rest support in a lowered position.
Figure 12:
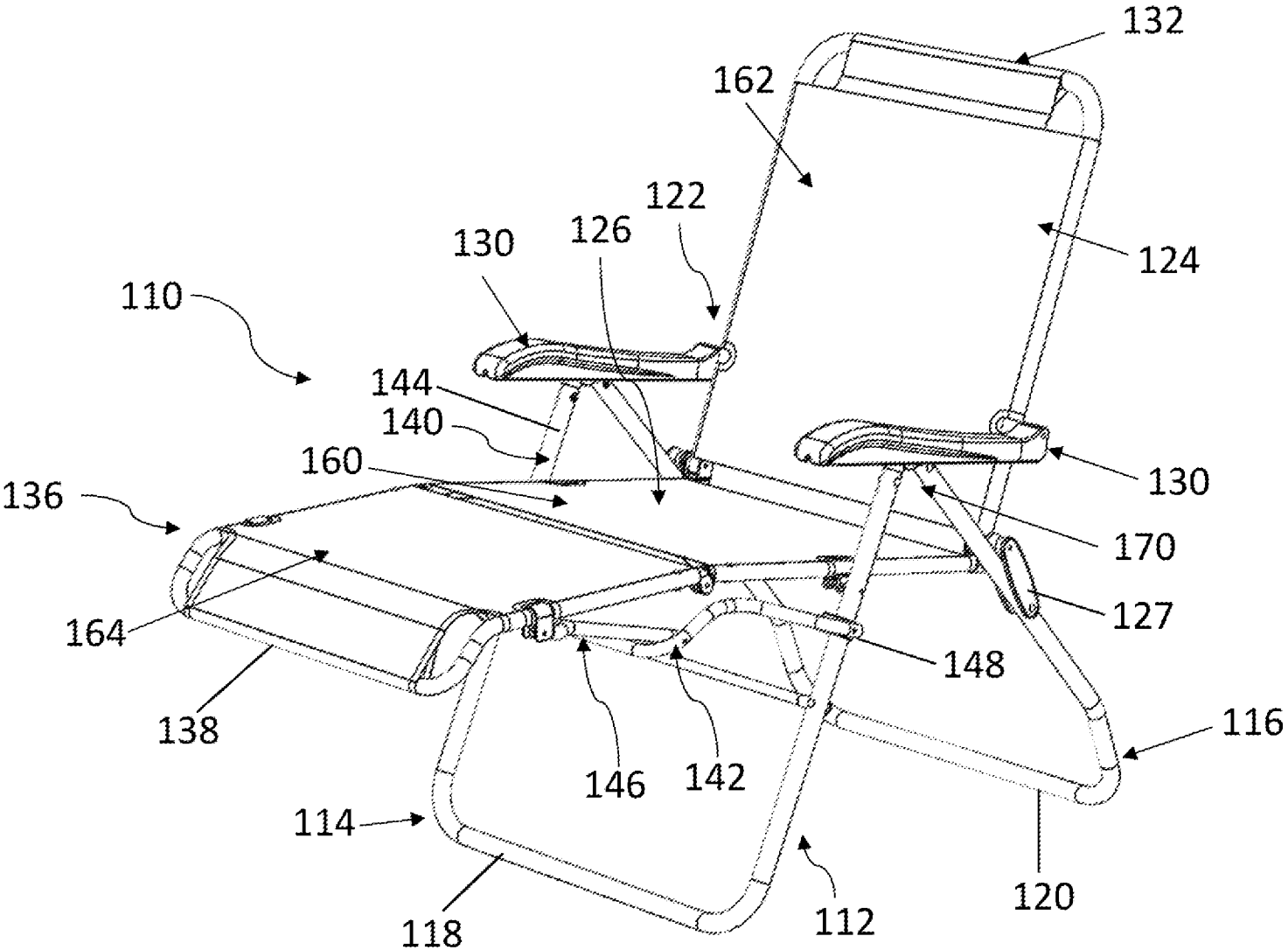
FIG. 12 is a perspective view of the collapsible and portable chair of FIG. 11 with the chair in a set-up condition and upright, and with the independently movable leg rest support in a raised position.
Figure 13:
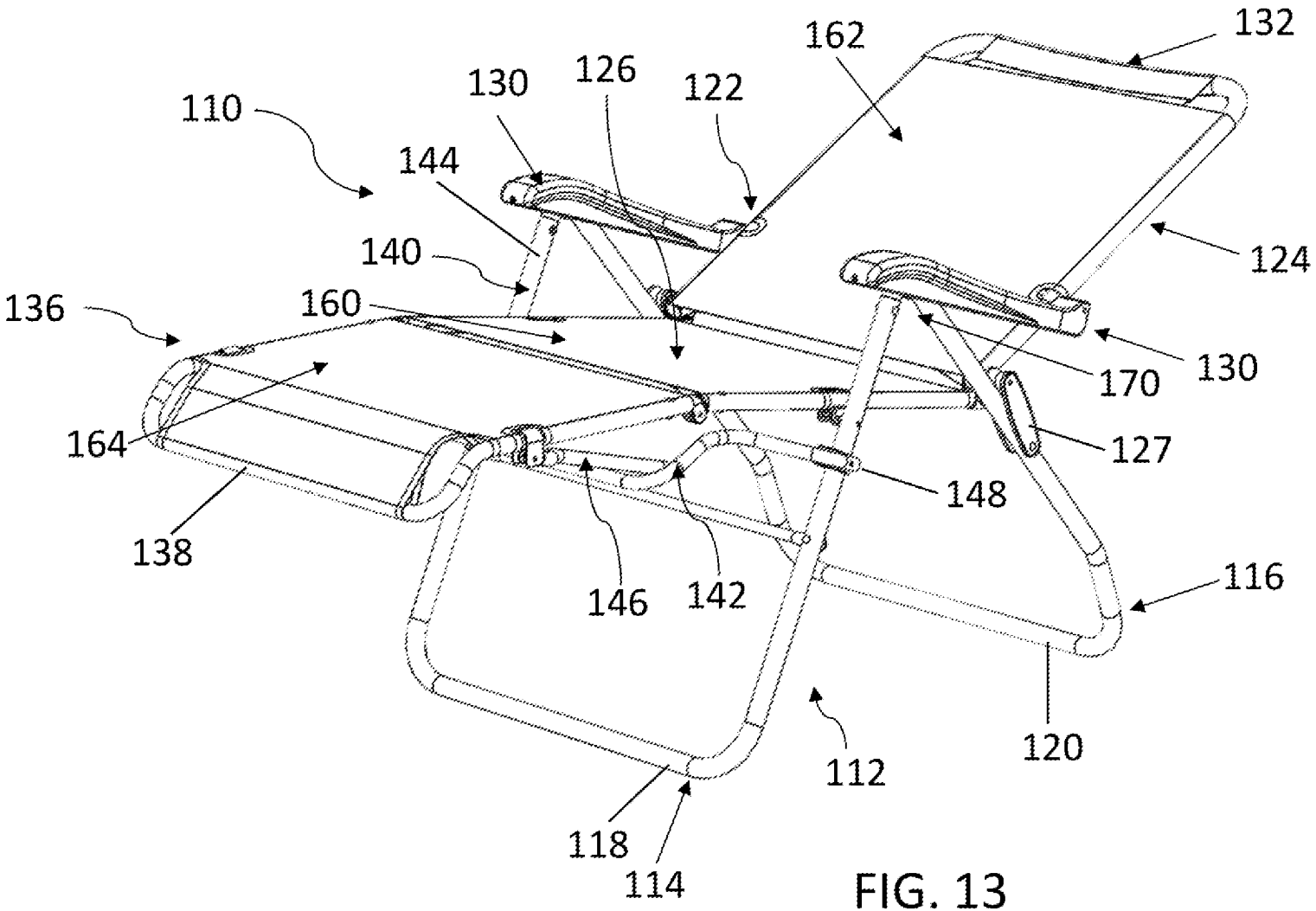
FIG. 13 is a perspective view of the collapsible and portable chair of FIG. 11 with the chair in a set-up condition and reclined, and with the independently movable leg rest support in a raised position.
Figure 14:
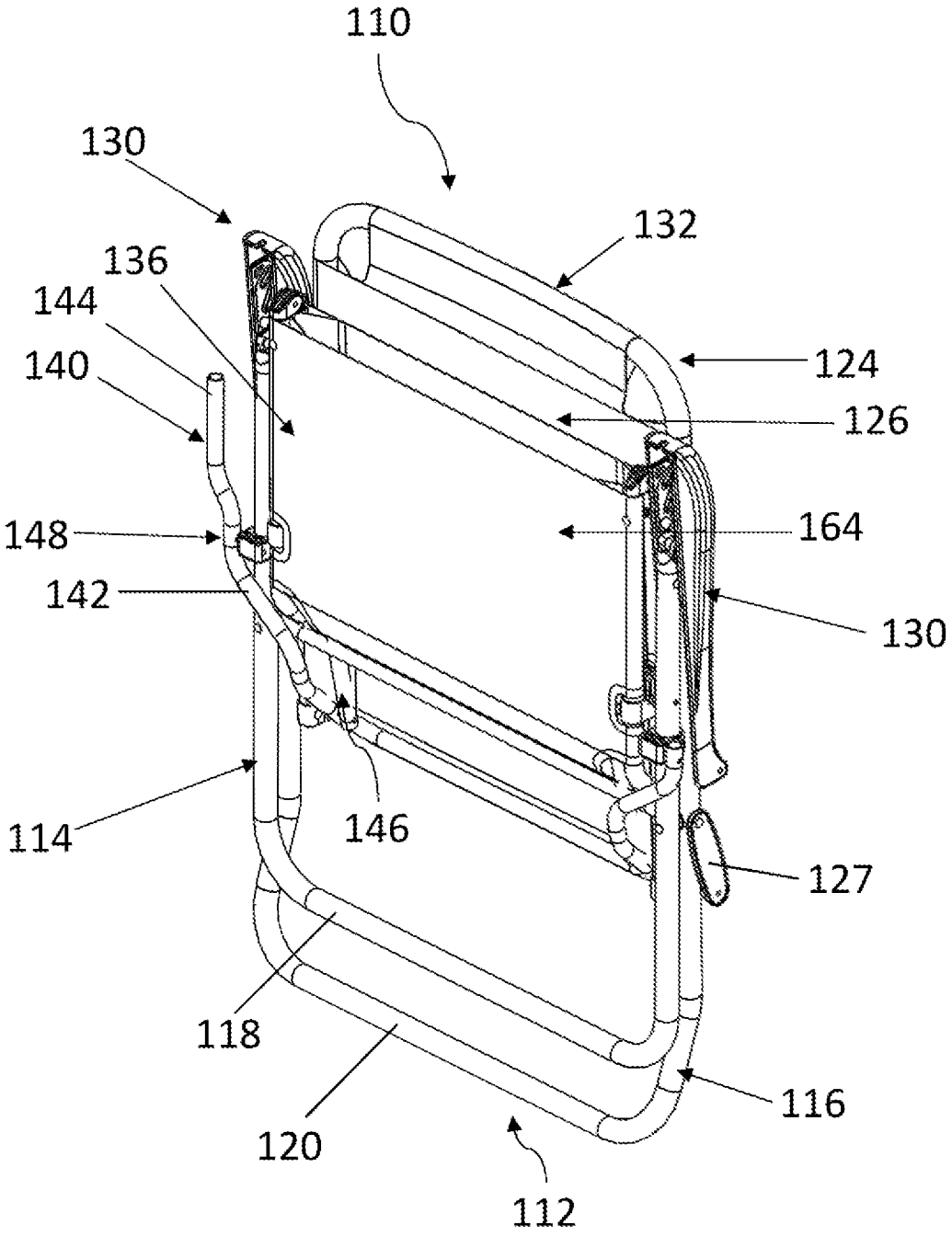
FIG. 14 is a perspective view of the collapsed and portable chair of FIG. 11 in a collapsed condition.
Figure 15:
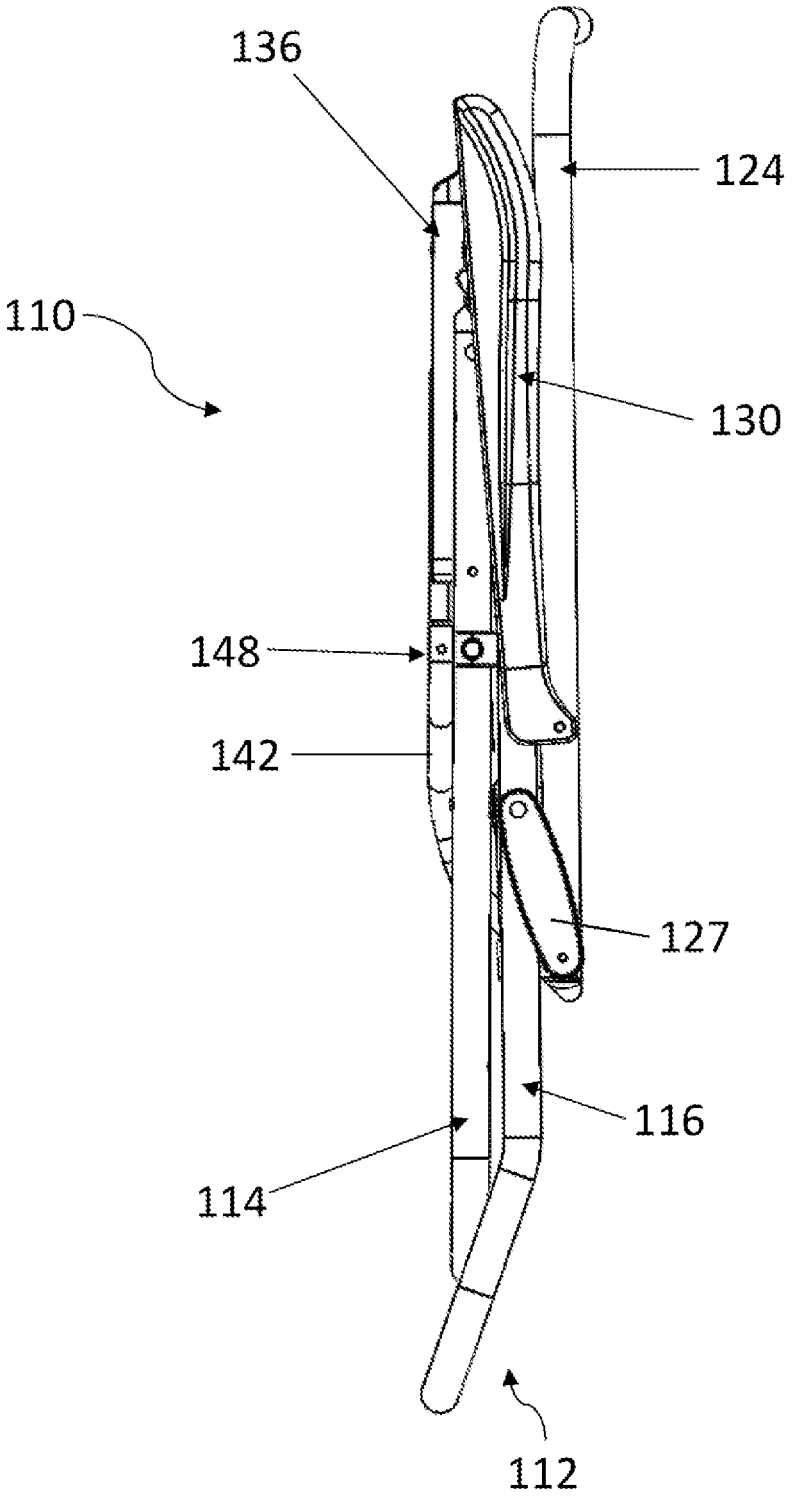
FIG. 15 is a planar side view of the collapsible and portable chair of FIG. 11 in the collapsed condition.
Figure 16:
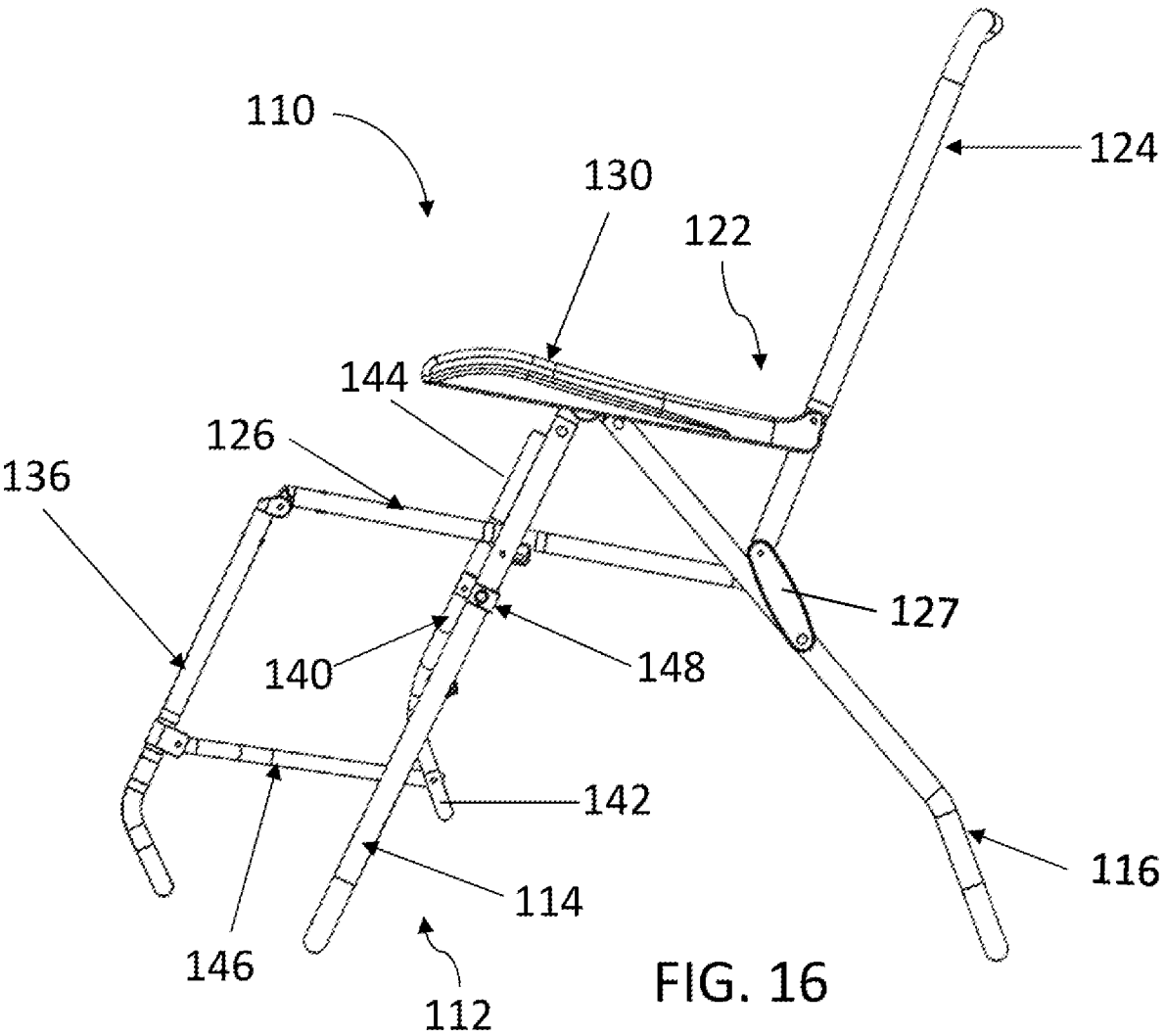
FIG. 16 is a planar side view of the collapsible and portable chair of FIG. 11 in the arrangement of FIG. 11.
Figure 17:
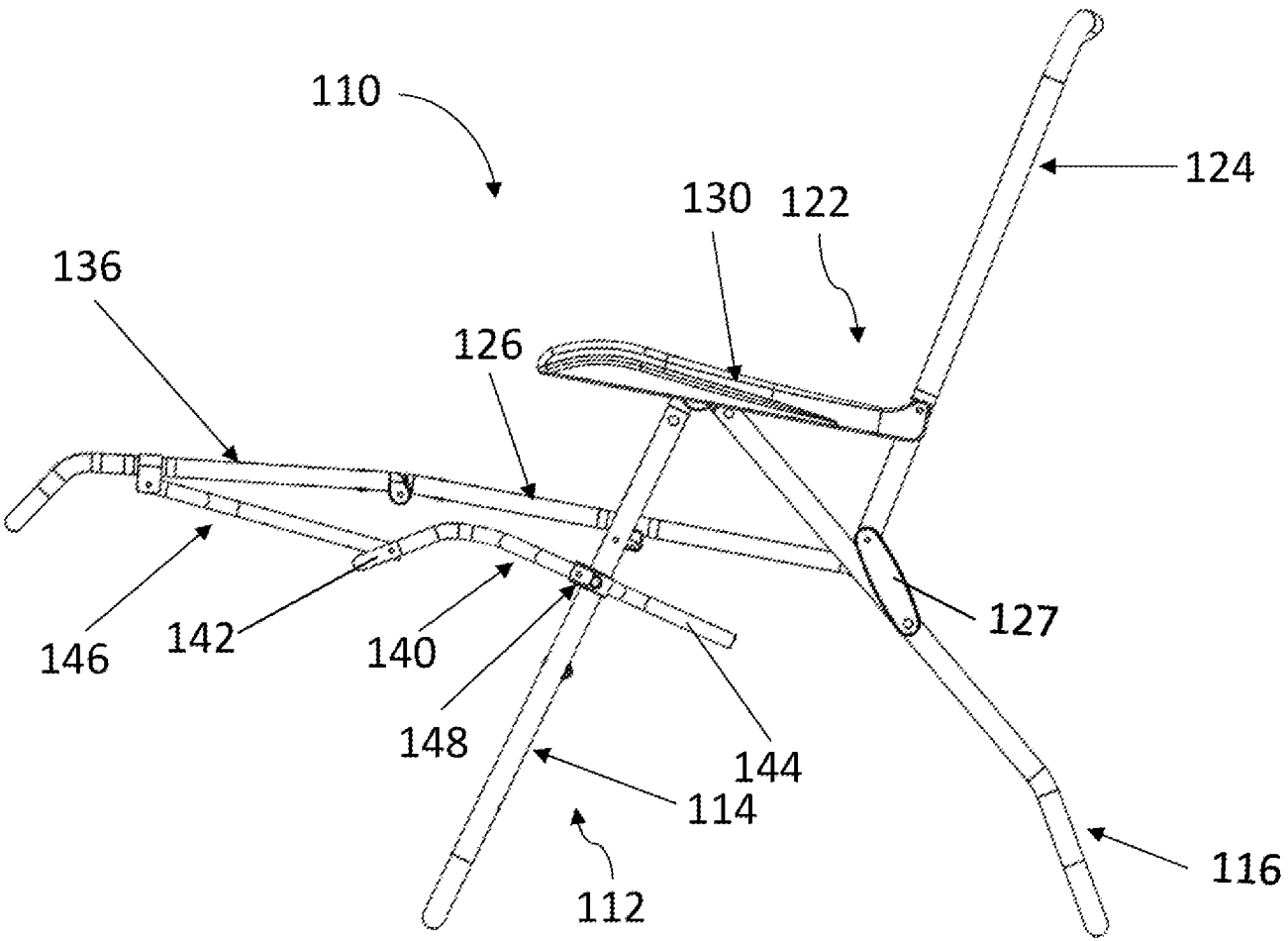
FIG. 17 is a planar side view of the collapsible and portable chair of FIG. 11 in the arrangement of FIG. 12.
Figure 18:
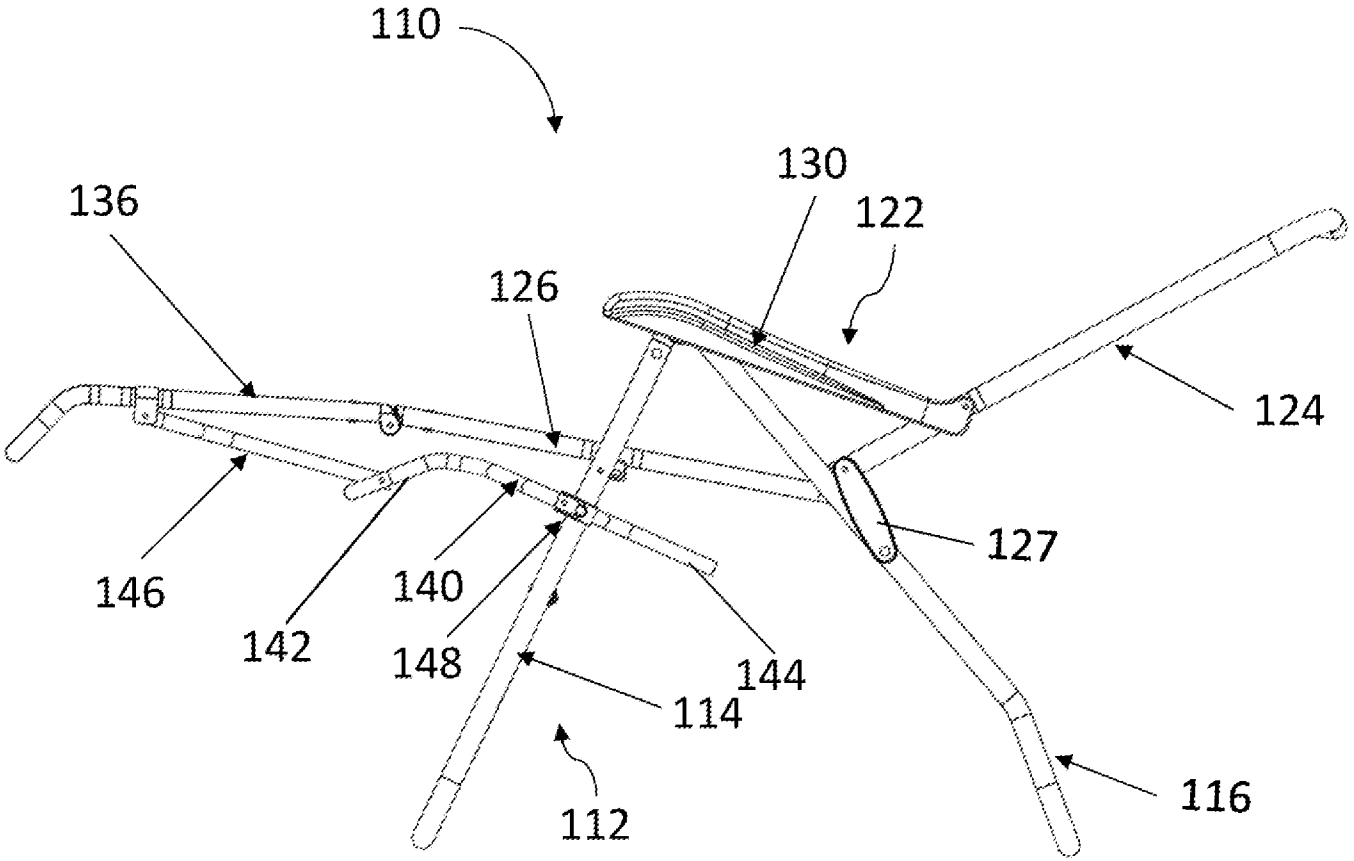
FIG. 18 is a planar side view of the collapsible and portable chair of FIG. 11 in the arrangement of FIG. 13.

Referring to FIGS. 11-19, an alternate embodiment of a collapsible and portable reclining chair in accordance with the present invention is illustrated and generally designated as reference numeral 110. As illustrated, the chair 110 is a front-to-back folding and reclining chair. In accordance with an aspect of the present invention, an independently movable leg rest extension is provided on the chair, as described herein. As a result, FIGS. 11 and 16 illustrate the chair 110 in a set-up and upright condition, with the independently movable leg rest in a lowered position. By comparison, FIGS. 12 and 17 illustrate the chair 110 in a set-up and upright condition, with the independently movable leg rest in a raised position. Still further, FIGS. 13 and 18 illustrate the chair 110 in a set-up and reclined condition, with the independently movable leg rest in a raised position. Though not illustrated, the chair 110 can be in its set-up and reclined position with the independently movable leg rest in a lowered position. Lastly, FIGS. 14-15 illustrate the chair 110 in its collapsed condition for transport and/or storage.

Referring to FIGS. 11-19, the chair 110 includes a chair frame comprising a leg assembly 112, a back support 124, a seat support 126 and an independent leg rest support 136, as illustrated. Such a chair 110 can be folded and unfolded between a set-up condition of the chair 110 for use, and a collapsed and folded condition of the chair 110 for transport and/or storage. In preferred embodiments, the chair 110 is folded in a front-to-back manner, as conventionally used for traditional lawn and beach chair designs, though, as noted, the present invention can also be used on chair designs adapted for folding in different manners, such as X-Y folding chairs and bi-fold chairs, without departing from the principles and spirit of the present invention.

Referring to FIGS. 16-18, the leg assembly 112 generally comprises front and rear legs 114 and 116 pivotally connected to each other. More particularly, the chair frame includes left and right mirrored frame members to effectively define left and right front and rear legs 114 and 116, as illustrated more clearly in FIGS. 11-13. More preferably, the chair 110 also includes transverse connectors 118 and 120 connecting the left and right leg members 114 and 116 that transversely support the chair frame in the set-up condition of the chair 110. Essentially, each of the front leg and rear leg 114 and 116 of the chair 110 resembles a U-shaped leg member having two parallel members interconnected by a transversely extending central portion, though, as noted above, alternate structural designs can be used without departing from the principles and spirit of the present invention.

The upper portions of the front and rear legs 114 and 116 are pivotally connected to each other so that the leg assembly 112 can be pivoted between a set-up condition—where the front and rear legs 114 and 116 are splayed apart to support the chair frame, as illustrated in FIGS. 16-18—and a collapsed condition—where the front and rear legs 114 and 116 are adjacent and generally parallel to one another relative to their set-up positions, as illustrated in FIG. 15.

The seat support 126 and the back support 124 are pivotally connected together to define a seating surface to receive a seated user in accordance with intended use of the chair 110. More particularly, the lower portion of the back support 124 is pivotally connected to the rear portion of the seat support 126. This pivotal connection is further connected to the rear legs via a linkage 127. The seat support 126 is pivotally connected to the front legs 114. As with the embodiment described above, left and right armrests 130 are pivotally connected at a rear end to the back support 124 and at the forward end to the leg assembly 112. In use, the back support 124 can be shifted between an upright position (e.g., a normal seated position of use), as illustrated in FIGS. 11 and 16, and a reclined position, as illustrated in FIGS. 12-13 and 17-18, where the back support 124 pivots backwards, as in accordance with known folding reclining chair designs.

Further, the seat support 126 and back support 124 can be folded and unfolded between the set-up condition (FIGS. 11-13 and 16-18) and the collapsed condition (FIGS. 14-15) of the chair 110 in coordination with the leg assembly 112.

As with a preferred design of the leg assembly 112, the back support 124 and seat support 126 of the chair frame includes left and right mirrored frame members to effectively define left and right back support members and seat support members. Additionally, the chair 110 also includes a transversely extending connector 132 connecting the left and right back support members 124 that helps support the weight of the seated user leaning back on the back support 124. Essentially, the back support 124 of the chair 110 resembles a U-shaped frame member having two parallel members interconnected by a transverse central portion, though alternate structural designs can be used without departing from the principles and spirit of the present invention. The seat support 126 is positioned between the back support 124 and the leg rest support 136, as illustrated.

The leg assembly 112 is connected to the armrests 130 in the same manner as described above, such that backwards and forward movement of the armrests 130 permits selective adjustment of the angular position of the back support 124 relative to the horizontal so that the user can position the back support 124 at a desired reclined position. More particularly, a seated user uses the armrests 130 to adjust the angular position of the back support 124 relative to the horizontal when the chair 110 is in its set-up condition and the user is seated in the chair 110. As the armrests 130 are moved rearward, preferably in coordination with a shifting of the seated user's weight, the armrests 130 push the back support 124 backwards in a downward pivoting manner relative to the seat support 126. However, in the illustrated embodiment, the reclining movement of the back support 124 generally does not affect the position of the seat support 126. More specifically, the position of the leg rest support 136 is not affected by movement of the back support 124 in accordance with the present invention.

As a result, in accordance with the present invention, the leg rest support 136 is independently movable relative to the seat support 126 and the back support 124. Referring to FIGS. 11-13, the leg rest support 136 is pivotally connected to the forward end of the seat support 126. The leg rest support 136 comprises a generally U-shape frame portion having parallel spaced apart left- and right-side frame members and a transversely extending central portion 138, though, as noted above, alternate structural designs can be used without departing from the principles and spirit of the present invention. In use, the leg rest support 136 can be pivotally shifted from a lowered position (as shown in FIGS. 11 and 16) to an upright position (as shown in FIGS. 12-13 and 17-18)—operating similar to a conventional LA-Z-BOY recliner using an actuating mechanism including a handle 140 disposed on a side of the chair frame that is moved by the user to effectuate movement of the leg rest 136 independent of any reclining adjustment of the back support 124.

Figure 19:
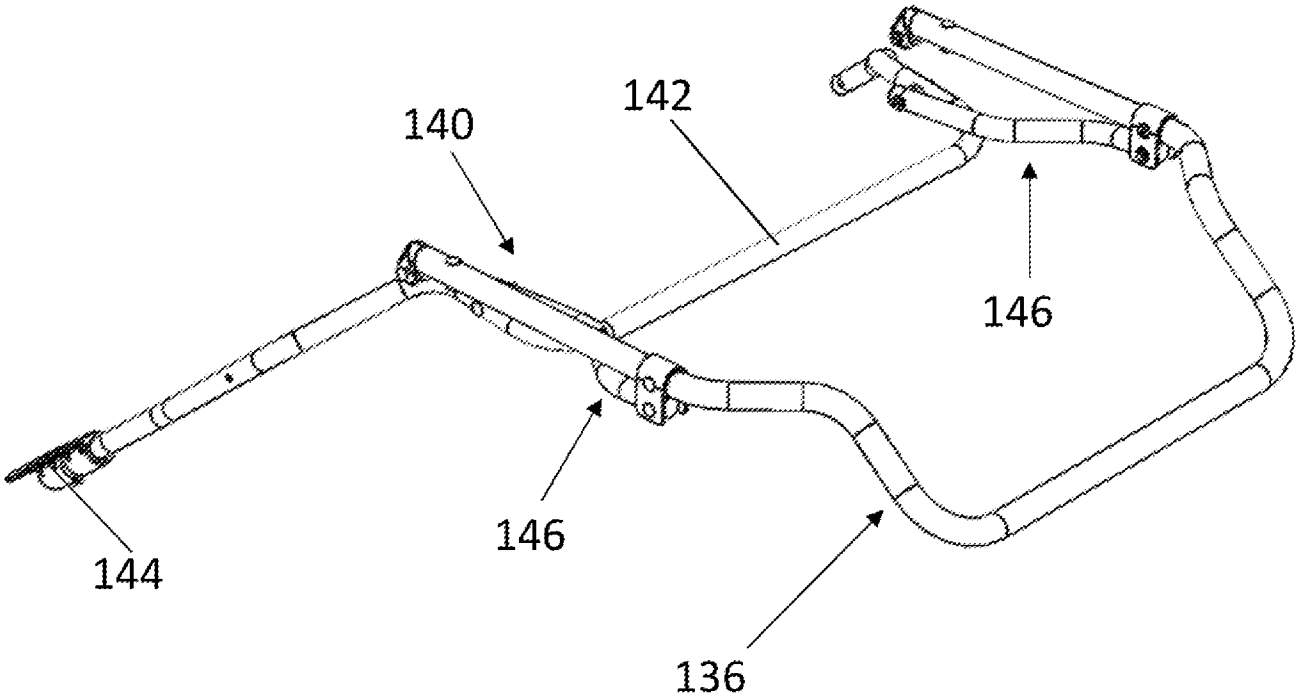
FIG. 19 is a perspective view of an isolated actuating mechanism in accordance with the present invention for use in effecting movement of the leg rest in the collapsible and portable chair of FIG. 11.

In accordance with preferred embodiments of the present invention and as generally illustrated in FIG. 19, the handle 140 is connected to the leg rest support 136 via a cam/linkage actuating mechanism that coordinates movement of the handle 140 with a responsive pivoting action of the leg rest support 136. As illustrated in FIGS. 14 and 19, the handle 140 generally comprises a U-shaped member 142 pivotally connected to and anchored by the front leg 114 of the leg assembly 112 using a sleeve or brace 148, providing a fulcrum for pivoting movement of the actuating mechanism, and having a grip 144 on at least one side for the user to manipulate as desired. The grip 144 is best seen in FIG. 19. In alternate designs, a grip 144 can be provided on both sides of the chair 110. The U-shaped handle member 142 is pivotally connected to generally parallelly spaced apart support members 146 connected between said U-shaped handle member 142 and the leg rest support 136. In the standard set-up condition of the chair, illustrated in FIGS. 11 and 16, the leg rest support 136 is down, and the U-shaped handle member 142 is directed upwards toward the armrests 130. In use, pushing down on the handle 140, to pivot it in a backward-downward direction, causes the support members 146 to pivot up, in turn lifting the leg rest support 136, so that the leg rest support 136 and the handle member 140 take the respective positions illustrated in FIGS. 12-13 and 17-18. When the handle 140 is pulled up, a reverse action occurs so that the leg rest support 136 can be pivoted down.

Therefore, the leg rest support 136 can be raised and lowered independently from the reclining of the back support 124. Comparing FIGS. 12 and 17 (upright chair) with FIGS. 13 and 18 (reclined chair), the positions of the leg rest support 136 and the handle member 140 are not affected by the position of the back support 124. Thus, the leg rest support 136 can be raised even when the chair 110 is in its upright (unreclined) set-up condition. The leg rest support 136 can likewise be raised in coordination with reclining the chair 110. Alternatively, the leg rest 136 can be lowered in the upright condition of the chair 110 as well as the reclined condition of the chair. These options differ from the prior art designs, which keep any leg rest or footrest extension rigidly connected to the rest of the frame and only allow the leg rest/footrest to go up if and when the chair is reclined.

Referring to FIGS. 11-13, the chair 110 further includes a seat panel 160 supported by the seat support 126, a back support panel 162 supported by the back support 124, and a leg rest panel 164 supported by the leg rest support 136 for collectively accommodating a user seated in the chair 110, though such panels 160, 162 and 164 need not be discrete and can be formed from a single or connected panel of fabric or flexible material.

When the chair 110 is collapsed, as illustrated in FIGS. 14 and 15, the back support 124, seat support 126 and leg rest support 136 fold together into a compact bundle. Indeed, as illustrated in FIG. 15, the seat support 126 and the leg rest support 136 essentially nest within the collapsed leg assembly 112. The shape of the U-shaped handle member 142 also conforms to the collapsed condition of the chair 110 so as to not interfere with the transportability and storability of the collapsed chair 110.

Figure 10A:
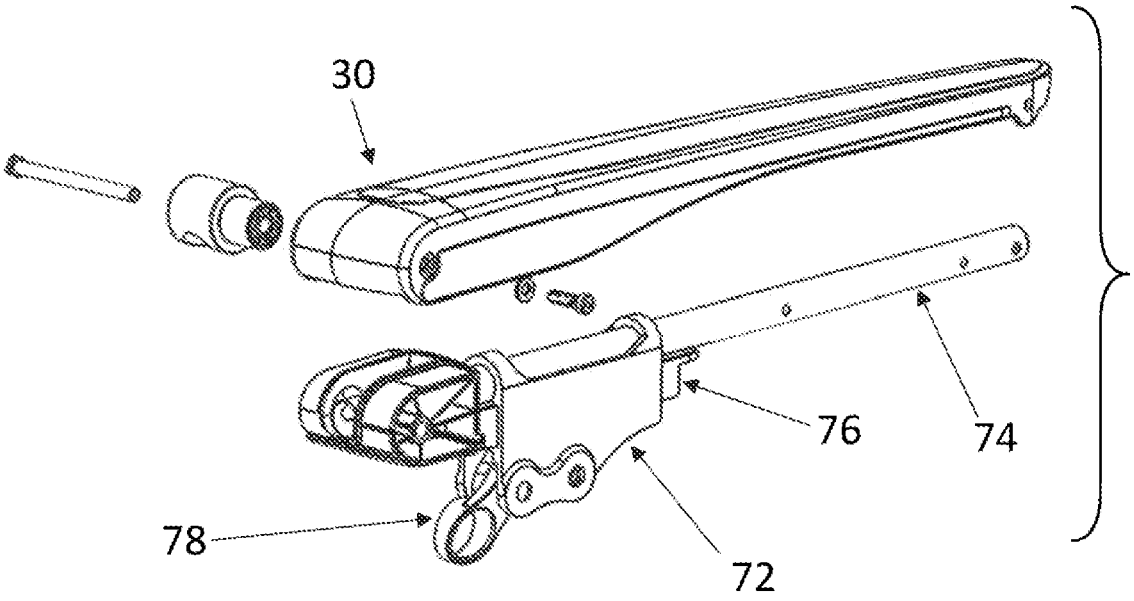
FIGS. 10A and 10B illustrate exploded views of an armrest and an automatic locking mechanism designed for use with a collapsible and portable chair in accordance with the present invention.

In accordance with the present invention, each armrest 30 also includes an adjustment mechanism for unlocking, moving, and then locking the position of the armrest 30. In an embodiment of the present invention illustrated in FIGS. 10A and 10B, the underside of each armrest 130 includes a slide mechanism 74 that is received within the respective slide housing 72 on the leg assembly 12.

Additionally, each armrest 30 includes a one-way autolock mechanism 76 which is always engaged to prevent the user from reclining and likewise prevent unintended rearward movement of the armrests 30 and back support 24. The lock mechanism 76 includes a spring-loaded trigger 78 that must be manually engaged and preferably held by the user to release the lock 76 and allow rearward motion of the armrests 30 to effectuate reclining of the seat assembly 22 in the embodiment of FIGS. 1-8 and the back support 124 in the embodiment of FIGS. 11-18. Conventional zero-gravity reclining chairs are generally unlocked and require manual locking of the armrests. As such, if the user forgets and does not lock the armrests in the prior art design, then there is a safety issue, as nothing prevents the automatic or unintentional recline of the back support. In contrast, the auto-lock mechanism 76 of the present invention means that each armrest 30 needs to be unlocked prior to moving the armrests 30; the armrests 30 and the back support 24 cannot move otherwise.

Figure 10B:
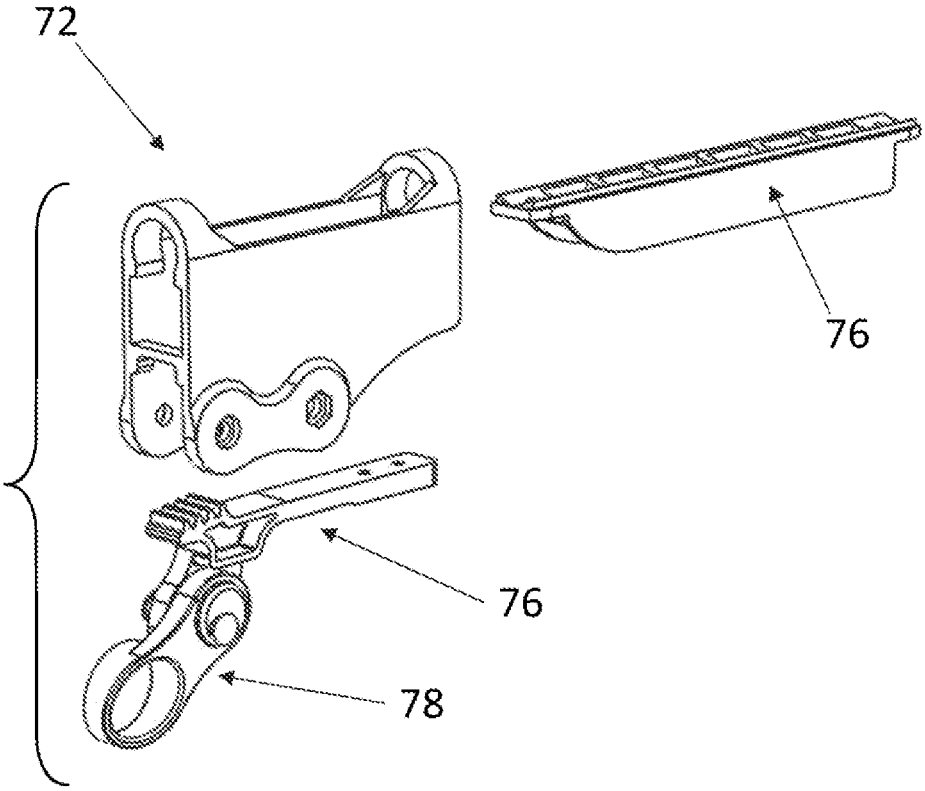

The "one-way" feature of the auto-lock mechanism 76 means that while rearward movement of the armrests 30 is restricted while locked, forward movement is still permitted. For example, the lock mechanism can include a spring-loaded ratchet system, as illustrated in FIG. 10B. As a result, the armrests 30 and back support 24 are not prevented from moving from a reclined position to an upright back support position. In this regard, a user can simply shift her weight forward and the armrests 30 will move forward so that the back support 24 moves with the user. After such movement, if the user leans back again, the back support 24 is locked and will not move until the trigger 78 is engaged on the armrests 30.

The auto-lock mechanism 76 also includes an automatic unlock cam that unlocks the armrests 30 when the chair 10 is folded (e.g., front-to-back like a conventional lawn chair). No user intervention is required to first manually unlock the armrests 30 and then fold the chair 10 per conventional prior art chair designs. However, while with the conventional chair design, the armrests will be unfolded in an unlocked condition and thus susceptible to unintended reclining when set-up, the present invention uses the auto-lock mechanism 76 to ensure that the armrests 30 will be locked upon set-up and thus safer than conventional reclining chairs.

The foregoing description of embodiments of the invention has been presented for the purpose of illustration and description. It is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated.

What is claimed is:

1. A collapsible and portable chair adapted to be folded and unfolded between a collapsed condition and a set-up condition, said chair comprising:

a chair frame defining a seat support and a back support, each of said seat support and said back support transversely extending between respective left and right portions and adapted to receive a seated user in the set-up condition of the chair;

a leg rest support pivotally connected to the chair frame and independently movable relative to said chair frame between a raised position and a lowered position in the set-up condition of the chair, said leg rest support transversely extending between a left portion and a right portion; and an actuating mechanism connected between the leg rest support and the chair frame to effect movement of the leg rest support between the raised position and the lowered position relative to the chair frame in the set-up condition of the chair frame, wherein said actuating mechanism comprises:

a U-shaped handle member defining a handle and a transversely extending member to effect collective movement of the left and right portions of the leg rest support when the handle is engaged, said U-shaped handle member being pivotally mounted to and anchored by the chair frame; and a secondary support linkage pivotally connected between the U-shaped handle member and the leg rest support;

whereby movement of the U-shaped handle member effects movement of the secondary support linkage, which effects movement of the leg rest support.

2. The collapsible and portable chair according to claim 1, wherein the chair frame further comprises a leg assembly defining a front leg member and a rear leg member, said leg assembly being adapted to be folded and unfolded with the chair frame.

3. The collapsible and portable chair according to claim 1, wherein the chair frame further comprises a leg assembly defining a front leg member and a rear leg member, said leg assembly being adapted to be folded and unfolded with the chair frame, and wherein the U-shaped handle member is anchored by the front leg member of the leg assembly.

4. The collapsible and portable chair according to claim 1, wherein the secondary support linkage comprises two generally parallel support members pivotally connected between the left and right portions of the leg rest support respectively and the U-shaped handle member.

5. The collapsible and portable chair according to claim 4, wherein the support members are pivotally connected to and anchored by the seat support.

6. A collapsible and portable chair adapted to be folded and unfolded between a collapsed condition and a set-up condition, said chair comprising:

a chair frame defining a seat support and a back support, each of said seat support and said back support transversely extending between respective left and right portions and adapted to receive a seated user in the set-up condition of the chair, and further comprising a leg assembly defining a front leg member and a rear leg member, said leg assembly being adapted to be folded and unfolded with the chair frame; and left and right armrests each mounted at a forward portion to the leg assembly and at a rearward portion to the back support;

a leg rest support pivotally connected to the chair frame and independently movable relative to said chair frame between a raised position and a lowered position in the set-up condition of the chair, said leg rest support transversely extending between a left portion and a right portion; and an actuating mechanism connected between the leg rest support and the chair frame to effect movement of the leg rest support between the raised position and the lowered position relative to the chair frame in the set-up condition of the chair frame, wherein said actuating mechanism comprises a handle and a transversely extending member to effect collective movement of the left and right portions of the leg rest support when the handle is engaged, and wherein said back support is adjustable to varying angular positions relative to the seat support such that movement of the armrests effects adjustment of the angular position of the back support relative to the seat support.

7. The collapsible and portable chair according to claim 6, wherein the armrests each include a one-way lock mechanism to restrict rearward angular adjustment of the back support until the lock mechanism is released.

8. The collapsible and portable chair according to claim 7, wherein the lock mechanism includes a manual trigger to release the lock mechanism so that the back support can be rearwardly reclined.

9. The collapsible and portable chair according to claim 6, wherein the chair frame further comprises a forward frame portion projecting from a forward end of the seat support and pivotally connected to the armrests.

10. A collapsible and portable chair adapted to be folded and unfolded between a collapsed condition and a set-up condition, said chair comprising:

a seat support transversely extending between a left seat support portion and a right seat support portion adapted to receive a seated user in the set-up condition of the chair;

a back support transversely extending between a left back support portion and a right back support portion against which a seated user can lean in the set-up condition of the chair;

a leg assembly defining a front leg member and a rear leg member, said leg assembly being adapted to be folded and unfolded with the chair;

a leg rest support pivotally connected to the seat support and independently movable relative to the seat support and the back support between a raised position and a lowered position in the set-up condition of the chair, said leg rest support transversely extending between a left leg rest support portion and a right leg rest support portion; and an actuating mechanism for moving the leg rest support between the raised position and the lowered position in the set-up condition of the chair, wherein said actuating mechanism comprises:

a U-shaped handle member pivotally mounted to and anchored by the leg assembly and defining a handle and a transversely extending member to effect collective movement of the left and right leg rest support portions between the raised position and the lowered position when the handle is engaged by a seated user; and a secondary support linkage pivotally connected between the U-shaped handle member and the leg rest support;

whereby movement of the U-shaped handle member effects movement of the secondary support linkage, which effects movement of the leg rest support.

11. The collapsible and portable chair according to claim 10, wherein the secondary support linkage comprises two generally parallel support members pivotally connected between the left and right leg rest support portions of the leg rest support respectively and the U-shaped handle member.

12. The collapsible and portable chair according to claim 10, further comprising left and right armrests each mounted at a forward portion to the leg assembly and at a rearward portion to the back support;

wherein movement of the armrests effects adjustment of the angular position of the back support relative to the seat support.

13. A collapsible and portable reclining chair adapted to be folded and unfolded between a collapsed condition and a set-up condition, said chair comprising:

a leg assembly defining a front leg member and a rear leg member, said leg assembly being adapted to be folded and unfolded with the chair;

a seat assembly pivotally mounted on and relative to the leg assembly, said seat assembly comprising:

a seat support;

a back support pivotally connected to the seat support and adjustable in the set-up condition of the chair to varying reclined positions relative to the seat support; and left and right armrests each mounted at a forward portion to the leg assembly and at a rearward portion to the back support, wherein movement of the armrests effects adjustment of the angular position of the back support;

a leg rest support pivotally connected to the seat assembly and independently movable relative to the seat assembly between a raised position and a lowered position in the set-up condition of the chair, said leg rest support transversely extending between a left leg rest support portion and a right leg rest support portion; and an actuating mechanism for moving the leg rest support between the raised position and the lowered position in the set-up condition of the chair, wherein said actuating mechanism comprises:

a transversely extending member adapted to effect collective movement of the left and right leg rest support portions between the raised position and the lowered position when engaged by a seated user;

a U-shaped handle member pivotally mounted to and anchored by the front leg member of the leg assembly, said U-shaped handle member defining the transversely extending member and a handle portion whereby movement of the handle portion effects movement of the transversely extending member; and a secondary support linkage pivotally connected between the U-shaped handle member and the leg rest support;

whereby movement of the U-shaped handle member effects movement of the secondary support linkage, which effects movement of the leg rest support.

14. The collapsible and portable reclining chair according to claim 13, wherein the secondary support linkage comprises two generally parallel support members pivotally connected between the left and right leg rest support portions of the leg rest support respectively and the U-shaped handle member.

15. The collapsible and portable reclining chair according to claim 14, wherein the support members are pivotally connected to and anchored by the seat support.

16. The collapsible and portable reclining chair according to claim 13, wherein the armrests each include a one-way lock mechanism to restrict rearward angular adjustment of the back support until the lock mechanism is released, said lock mechanism including a manual trigger to release the lock mechanism so that the back support can be rearwardly reclined.

17. A collapsible and portable chair adapted to be folded and unfolded between a collapsed condition and a set-up condition, said chair comprising:

a chair frame defining a seat support and a back support, each of said seat support and said back support transversely extending between respective left and right portions and adapted to receive a seated user in the set-up condition of the chair;

a leg rest support pivotally connected to the chair frame and independently movable relative to said chair frame between a raised position and a lowered position in the set-up condition of the chair, said leg rest support transversely extending between a left portion and a right portion; and an actuating mechanism connected between the leg rest support and the chair frame to effect movement of the leg rest support between the raised position and the lowered position relative to the chair frame in the set-up condition of the chair frame, wherein said actuating mechanism comprises a handle and a transversely extending member to effect collective movement of the left and right portions of the leg rest support when the handle is engaged; and wherein the actuating mechanism further comprises an over-center linkage to lock the leg rest support relative to the chair frame when said leg rest support is in the raised position.

18. A collapsible and portable chair adapted to be folded and unfolded between a collapsed condition and a set-up condition, said chair comprising:

a seat support transversely extending between a left seat support portion and a right seat support portion adapted to receive a seated user in the set-up condition of the chair;

a back support transversely extending between a left back support portion and a right back support portion against which a seated user can lean in the set-up condition of the chair;

a leg assembly defining a front leg member and a rear leg member, said leg assembly being adapted to be folded and unfolded with the chair;

a leg rest support pivotally connected to the seat support and independently movable relative to the seat support and the back support between a raised position and a lowered position in the set-up condition of the chair, said leg rest support transversely extending between a left leg rest support portion and a right leg rest support portion; and an actuating mechanism for moving the leg rest support between the raised position and the lowered position in the set-up condition of the chair, wherein said actuating mechanism comprises a handle and a transversely extending member to effect collective movement of the left and right leg rest support portions between the raised position and the lowered position when the handle is engaged by a seated user, and wherein the actuating mechanism further comprises an over-center linkage to lock the leg rest support relative to the seat support when said leg rest support is in the raised position.

19. A collapsible and portable reclining chair adapted to be folded and unfolded between a collapsed condition and a set-up condition, said chair comprising:

a leg assembly defining a front leg member and a rear leg member, said leg assembly being adapted to be folded and unfolded with the chair;

a seat assembly pivotally mounted on and relative to the leg assembly, said seat assembly comprising:

a seat support;

a back support pivotally connected to the seat support and adjustable in the set-up condition of the chair to varying reclined positions relative to the seat support; and left and right armrests each mounted at a forward portion to the leg assembly and at a rearward portion to the back support, wherein movement of the armrests effects adjustment of the angular position of the back support;

a leg rest support pivotally connected to the seat assembly and independently movable relative to the seat assembly between a raised position and a lowered position in the set-up condition of the chair, said leg rest support transversely extending between a left leg rest support portion and a right leg rest support portion; and an actuating mechanism for moving the leg rest support between the raised position and the lowered position in the set-up condition of the chair, wherein said actuating mechanism comprises a transversely extending member adapted to effect collective movement of the left and right leg rest support portions between the raised position and the lowered position when engaged by a seated user, wherein the actuating mechanism further comprises an over-center linkage to lock the leg rest support relative to the seat assembly when said leg rest support is in the raised position.

20. A collapsible and portable chair adapted to be folded and unfolded between a collapsed condition and a set-up condition, said chair comprising:

a chair frame defining a seat support and a back support, each of said seat support and said back support transversely extending between respective left and right portions and adapted to receive a seated user in the set-up condition of the chair;

a leg rest support pivotally connected to the chair frame and independently movable relative to said chair frame between a raised position and a lowered position in the set-up condition of the chair, said leg rest support transversely extending between a left portion and a right portion; and an actuating mechanism connected between the leg rest support and the chair frame to effect movement of the leg rest support between the raised position and the lowered position relative to the chair frame in the set-up condition of the chair frame, wherein said actuating mechanism comprises a handle position positioned on each of the left and right sides of the chair frame and a transversely extending member, each of said handles being connected to the transversely extending member so that said transversely extending member can effect collective movement of the left and right portions of the leg rest support when either handle is engaged.

21. A collapsible and portable reclining chair adapted to be folded and unfolded between a collapsed condition and a set-up condition, said chair comprising:

a chair frame defining a seat support and a back support, said back support being adjustable to varying angular positions relative to the seat support;

a leg rest support pivotally connected to the chair frame and independently movable relative to said chair frame between a raised position and a lowered position in the set-up condition of the chair; and an actuating mechanism connected between the leg rest support and the chair frame to effect movement of the leg rest support between a raised position and a lowered position relative to the chair frame in the set-up condition of the chair frame, wherein the actuating mechanism comprises:

a U-shaped handle member pivotally mounted to and anchored by the chair frame; and a secondary support linkage pivotally connected between the U-shaped handle member and the leg rest support, and whereby movement of the U-shaped handle effects movement of the secondary support linkage, which effects movement of the leg rest support.

* * * * *